United States Patent [19]

Codos

[11] Patent Number: 4,788,921

[45] Date of Patent: Dec. 6, 1988

[54] SEWING MACHINE HAVING ROTATABLE AND AXIALLY MOVABLE FRAME

[75] Inventor: Richard N. Codos, Warren, N.J.

[73] Assignee: Pathe Computer Systems, Inc., Irvington, N.J.

[21] Appl. No.: 57,252

[22] Filed: Jun. 3, 1987

Related U.S. Application Data

[63] Continuation-in-part of Ser. No. 881,846, Jul. 3, 1986, Pat. No. 4,716,845.

[51] Int. Cl.[4] ..... D05B 11/00

[52] U.S. Cl. ..... 112/118; 112/270

[58] Field of Search ..... 112/118, 117, 119, 270, 112/80.32

[56] References Cited

U.S. PATENT DOCUMENTS

| | | | |
|---|---|---|---|
| 351,468 | 10/1886 | Schultz | 112/118 X |
| 447,794 | 3/1891 | Schultz et al. | 112/118 X |
| 448,253 | 3/1891 | Palmer | 112/118 X |
| 456,726 | 7/1891 | Koch | 112/118 |
| 467,138 | 1/1892 | Hadley | 112/118 X |
| 1,937,491 | 11/1933 | May | 112/117 |
| 1,946,868 | 2/1934 | May | 112/118 |
| 2,377,951 | 6/1945 | May | 112/117 |
| 3,180,393 | 4/1965 | Cash | 112/118 |
| 3,677,207 | 7/1972 | Iwase | 112/118 |
| 4,015,550 | 4/1977 | Bartenfeld et al. | 112/80.32 X |
| 4,465,005 | 8/1984 | Eguchi et al. | 112/270 |

*Primary Examiner*—H. Hampton Hunter
*Attorney, Agent, or Firm*—Klauber & Jackson

[57] ABSTRACT

A quilting machine includes a base having three bridges; a sewing head secured to the upper bridge; a cylindrically shaped frame slidably and rotatably mounted on the lower two bridges, the frame including first and second end assemblies spaced from each other on the lower bridges, each having a support casting slidably mounted on the base and a ring rotatably mounted on a support casting, each ring including circumferential gear teeth, gears meshing with the gear teeth and extending from the support castings for supporting the rings, a plurality of first and second telescoping rods secured to the first and second end assemblies, at least one first telescoping rod screw-threadedly receiving a second telescoping rod, and at least one first and second telescoping rod rotatably fixed and axially movable with respect to each other, a gear secured to each of the latter in meshing engagement with the gear teeth of the respective rings; a mechanism for rotating the axially movable and rotatably fixed first and second telescoping rods to rotate the rings; an elongation mechanism for rotating one of the first and second screw-threaded telescoping rods to change the length of the frame; a lead screw, belt or chain assembly for axially moving the frame along the lower bridges of the base; clamps secured to the outer circumference of each ring for clamping fabric to the frame; friction rollers having a height substantially even with the rings and driven by the gears on the support castings for guiding the fabric with respect to the sewing head; a clamping assembly extending axially of the frame for clamping the free end of a fabric tensioned on the frame; a painting assembly positioned above the fabric and adjacent the sewing head for painting a pattern on the fabric; and an external control device such as a mouse for manually controlling movement of the frame.

26 Claims, 30 Drawing Sheets

SEWING MACHINE HAVING ROTATABLE AND AXIALLY MOVABLE FRAME

REFERENCE TO RELATED APPLICATION

This application is a continuation-in-part of U.S. patent application Ser. No. 881,846, filed July 3, 1986, now U.S. Pat. No. 4,716,845, dated Jan. 5, 1988 entitled SEWING MACHINE HAVING ROTATABLE AND AXIALLY MOVABLE FRAME to the same inventor herein.

BACKGROUND OF THE INVENTION

This invention relates generally to sewing machines for sewing quilts, comforters and analogous articles and, more particularly, is directed to a sewing machine having a rotatable and axially movable cylindrically-shaped frame for holding the fabric.

Because of the large size of quilts, comforters and the like, it is difficult to sew patterns thereon. Further, apparatus for sewing the same must occupy a substantial amount of space because of the large size of quilts and comforters, thereby rendering such apparatus inefficient and space consuming.

In order to overcome some of the disadvantages of conventional apparatus, a sewing machine for sewing quilts, comforters and the like has been designed with a substantially cylindrical frame which is rotatable and axially movable on a base and which can expand or contract its lengthwise dimension. Examples of such sewing machines are found in U.S. Pat. Nos. 351,468; 447,794; 448,253; 456,726; 467,138; 1,937,491; 1,946,868; and 2,377,951.

For example, U.S. Pat. No. 1,937,491 generally discloses a rotatable quilting machine having a substantially cylindrical frame axially movable along a base by pulleys which ride upon a central sleeve of the base and by pulleys which cooperate with an upper T-rail of the base.

The frame is manually moved along the base by the operator.

The length of the frame is also manually adjustable by adjustable collars, and the frame is rotatably mounted upon the aforementioned central sleeve and manually rotated by raising or lowering of a bar by the operator.

U.S. Pat. No. 1,946,868 discloses a similar arrangement. However, a first rod extends from one end and includes internal screw threads and a second rod extends from the opposite end and is screw-threadedly received within the first rod. A crank handle rotates one of the rods to move the outer rings of the cylindrical frame closer together or further apart.

U.S. Pat. No. 2,377,951 expands on the previous Patent by providing a plurality of such screw-threaded telescoping members In addition, drive sprockets are provided at the ends of the screw-threaded members at each end of the frame, and a chain passes over the drive sprockets and various idler sprockets. By means of a wrench which can be placed on a non-circular portion of one of the screw-threaded shafts for rotating the same, all of the screw-threaded shafts at the same end of the frame are rotated by means of the chain drive.

Various other ones of the Patents, such as U.S. Pat. No. 467,138 discloses a rotatable drive mechanism in which the outer rings are provided with gear teeth. Through suitable gearing and a manual crank wheel, the frame can be rotated about a central shaft. See also U.S. Pat. No. 448,253.

As to the axial movement of the frame, U.S. Pat. No. 456,726 discloses the use of two cams which coact with projections to provide side-to-side movement of the carriage in a specific pattern With all of the above patents, however, the arrangements that are provided for rotating and axially moving the frame are relatively complicated and consume unnecessary space. In addition, there are no automatic means, such as motor means or the like, for controlling rotation, axial movement and elongation of the frame.

In the above discussed patents, the fabric of the quilt or comforter is secured at opposite ends about the substantially cylindrical frame by means of clamping fingers or the like which are manually set. See, for example, U.S. Pat. No. 1,937,491. However, the securement of the fabric to the frame is time consuming and tedious, and therefore inefficient.

OBJECTS AND SUMMARY OF THE INVENTION

Accordingly, it is an object of the present invention to provide a sewing machine for quilts, comforters and the like that avoids the aforementioned difficulties.

It is another object of the present invention to provide a sewing machine for quilts, comforters and the like having a substantially cylindrical frame, including respective motors for axially and rotatably driving the frame with respect to a base and for changing the length of the frame on the base.

It is still another object of the present invention to provide a sewing machine for quilts, comforters and the like having a substantially cylindrical frame axially movable along a base by means of a lead screw, belt or chain arrangement.

It is a further object of the present invention to provide a sewing machine for quilts, comforters and the like having a cylindrical frame with friction rollers that guide the fabric during rotation of the frame to prevent the formation of pleats and wrinkles therein.

It is a still further object of the present invention to provide a sewing machine for quilts, comforters and the like having a cylindrical frame and a clamping assembly extending axially of the frame for clamping the free end of the fabric tensioned on the frame.

It is a yet further object of the present invention to providing a sewing machine for quilts, comforters and the like having a cylindrical frame and a painting assembly positioned above the fabric and adjacent the sewing head for painting a pattern on the fabric with no misalignment between the painted and sewn pattern.

It is another object of the present invention to provide a sewing machine for quilts, comforters and the like having a cylindrical frame and an external control device for controlling movement of the frame in response to a manual input so as to individualize patterns, correct misalignment and the like.

In accordance with a first aspect of the present invention, a quilting machine includes:

(a) a base;

(b) a substantially cylindrically shaped frame slidably and rotatably mounted on the base, the frame including:

(i) a first end assembly;

(ii) a second end assembly;

(iii) each end assembly having a support member slidably mounted on the base and a ring rotatably mounted on the respective support member, each ring having a plurality of gear teeth spaced therearound;

(iv) the first and second end assemblies spaced from each other on the base;

(v) a plurality of first telescoping rods secured to the first end assembly and extending toward the second end assembly;

(vi) a plurality of second telescoping rods secured to the second end assembly and extending toward the first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of said first and second rotatably fixed and axially movable telescoping rods in mating engagement with said gear teeth of said rings;

(c) rotation means for rotating the rings with respect to the support members and including first rod rotation means for rotating said first and second rotatably fixed and axially movable telescoping rods;

(d) elongation means for changing the length of the frame, including second rod rotation means for rotating at least one screw-threaded rod; and (e) frame moving means for axially moving the frame along the base, the frame moving means including a lead screw having a helical thread secured to the base, drive means mounted on the frame in rotatable engagement with the lead screw for movement therealong, and control means for controlling rotation of one of the drive means and the lead screw to move the frame along the base.

In accordance with another aspect of the present invention, a quilting machine includes:

(a) a base;

(b) a substantially cylindrically shaped frame slidably and rotatably mounted on the base, the frame including:

(i) a first end assembly;

(ii) a second end assembly;

(iii) each end assembly having a support member slidably mounted on the base and a ring rotatably mounted on the respective support member, each ring having a plurality of gear teeth spaced therearound;

(iv) the first and second end assemblies spaced from each other on the base;

(v) a plurality of first telescoping rods secured to the first end assembly and extending toward the second end assembly;

(vi) a plurality of second telescoping rods secured to the second end assembly and extending toward the first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of the first and second rotatably fixed and axially movable telescoping rods in mating engagement with said gear teeth of said rings;

(c) rotation means for rotating the rings with respect to the support members and including first rod rotation means for rotating the first and second rotatably fixed and axially movable telescoping rods;

(d) elongation means for changing the length of the frame, including second rod rotation means for rotating at least one screw-threaded rod; and (e) frame moving means for axially moving the frame along the base, the frame moving means including first roller means secured to one end of the base, second roller means secured to a second opposite end of the base, belt means wrapped about the first and second roller means and secured to the frame for moving the frame longitudinally with respect to the base, and drive means for rotatably driving one of the rollers.

In accordance with still another aspect of the present invention, a quilting machine includes:

(a) a base;

(b) a substantially cylindrically shaped frame slidably and rotatably mounted on the base, the frame including:

(i) a first end assembly;

(ii) a second end assembly;

(iii) each end assembly having a support member slidably mounted on the base and a ring rotatably mounted on the respective support member, each ring having a plurality of gear teeth spaced therearound;

(iv) the first and second end assemblies spaced from each other on the base;

(v) a plurality of first telescoping rods secured to the first end assembly and extending toward the second end assembly;

(vi) a plurality of second telescoping rods secured to the second end assembly and extending toward the first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of the first and second rotatably fixed and axially movable telescoping rods in mating engagement with said gear teeth of said rings;

(c) rotation means for rotating the rings with respect to the support members and including first rod rotation means for rotating the first and second rotatably fixed and axially movable telescoping rods;

(d) elongation means for changing the length of the frame, including second rod rotation means for rotating at least one screw-threaded rod; and (e) frame moving means for axially moving the frame along the base, the frame moving means including chain means secured to opposite ends of the base for guiding the frame therealong, gear means mounted on the frame and in engagement with the chain means for moving along the chain means during rotation of the gear means, and drive means connected to the gear means and to the frame for driving the gear means to cause the frame to move axially along the base.

In accordance with yet another aspect of the present invention, a quilting machine includes:

(a) a base;

(b) a substantially cylindrically shaped frame slidably and rotatably mounted on the base, the frame including:

(i) a first end assembly;

(ii) a second end assembly;

(iii) each end assembly having a support member slidably mounted on the base and a ring rotatably mounted on the respective support member, each ring having a plurality of gear teeth spaced therearound;

(iv) the first and second end assemblies spaced from each other on the base;

(v) a plurality of first telescoping rods secured to the first end assembly and extending toward the second end assembly;

(vi) a plurality of second telescoping rods secured to the second end assembly and extending toward the first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of the first and second rotatably fixed and axially movable telescoping rods in mating engagement with the gear teeth of the rings;

(c) rotation means for rotating the rings with respect to the support members and including first rod rotation means for rotating the first and second rotatably fixed and axially movable telescoping rods;

(d) elongation means for changing the length of the frame, including second rod rotation means for rotating at least one screw-threaded rod; and (e) frame moving means for axially moving the frame along the base, the frame moving means including chain means for guiding the frame axially along the base, the chain means having a first end connected to the first end assembly and a second end connected to the second end assembly, gear means secured to the base in engagement with the chain means for movement along the chain means during rotation of the gear means, and drive means secured to the base for rotatably driving the gear means.

In accordance with a further aspect of the present invention, a quilting machine includes:

(a) a base;

(b) a substantially cylindrically shaped frame slidably and rotatably mounted on the base, the frame including:

(i) a first end assembly;

(ii) a second end assembly;

(iii) each end assembly having a support member slidably mounted on the base and a ring rotatably mounted on the respective support member, each ring having a plurality of gear teeth spaced therearound;

(iv) the first and second end assemblies spaced from each other on the base;

(v) a plurality of first telescoping rods secured to the first end assembly and extending toward the second end assembly;

(vi) a plurality of second telescoping rods secured to the second end assembly and extending toward the first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of the first and second rotatably fixed and axially movable telescoping rods in mating engagement with the gear teeth of the rings;

(c) rotation means for rotating the rings with respect to the support members and including first rod rotation means for rotating the first and second rotatably fixed and axially movable telescoping rods;

(d) elongation means for changing the length of the frame, including second rod rotation means for rotating at least one screw-threaded rod;

(e) sewing means positioned on the base for stitching a fabric stretched on the frame; and (f) friction roller means for guiding the fabric with respect to the sewing means, the friction roller means including a plurality of friction rollers rotatably mounted to the frame and rotatable by the rotation means, each friction roller having a height substantially even with the rings.

In accordance with a still further aspect of the present invention, a quilting machine includes:

(a) a base;

(b) a substantially cylindrically shaped frame slidably and rotatably mounted on the base, the frame including:

(i) a first end assembly;

(ii) a second end assembly;

(iii) each end assembly having a support member slidably mounted on the base and a ring rotatably mounted on the respective support member, each ring having a plurality of gear teeth spaced therearound;

(iv) the first and second end assemblies spaced from each other on the base;

(v) a plurality of first telescoping rods secured to the first end assembly and extending toward the second end assembly;

(vi) a plurality of second telescoping rods secured to the second end assembly and extending toward the first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of the first and second rotatably fixed and axially movable telescoping rods in mating engagement with the gear teeth of the rings;

(c) rotation means for rotating the rings with respect to the support members and including first rod rotation means for rotating the first and second rotatably fixed and axially movable telescoping rods;

(d) elongation means for changing the length of the frame, including second rod rotation means for rotating at least one screw-threaded rod; and (e) clamp means extending axially of the frame for clamping a free end of a fabric tensioned on the frame.

In accordance with a yet further aspect of the present invention, a quilting machine includes:

(a) a base;

(b) a substantially cylindrically shaped frame slidably and rotatably mounted on the base, the frame including:

(i) a first end assembly;

(ii) a second end assembly;

(iii) each end assembly having a support member slidably mounted on the base and a ring rotatably mounted on the respective support member, each ring having a plurality of gear teeth spaced thereearound;

(iv) the first and second end assemblies spaced from each other on the base;

(v) a plurality of first telescoping rods secured to the first end assembly and extending toward the second end assembly;

(vi) a plurality of second telescoping rods secured to the second end assembly and extending toward the first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of the first and second rotatably fixed and axially movable telescoping rods in mating engagement with the gear teeth of the rings;

(c) rotation means for rotating the rings with respect to the support members and including first rod rotation means for rotating the first and second rotatably fixed and axially movable telescoping rods;

(d) elongation means for changing the length of the frame, including second rod rotation means for rotating at least one screw-threaded rod;

(e) sewing head means having a needle positioned above a fabric stretched on the frame for sewing a pattern on the fabric; and (f) paint head means positioned above the fabric and adjacent the sewing head means for painting a pattern on the fabric.

In accordance with another aspect of the present invention, a quilting machine includes:

(a) a base;

(b) a substantially cylindrically shaped frame slidably and rotatably mounted on the base, the frame including:

(i) a first end assembly;

(ii) a second end assembly;

(iii) each end assembly having a support member slidably mounted on the base and a ring rotatably mounted on the respective support member, each ring having a plurality of gear teeth spaced thereearound;

(iv) the first and second end assemblies spaced from each other on the base;

(v) a plurality of first telescoping rods secured to the first end assembly and extending toward the second end assembly;

(vi) a plurality of second telescoping rods secured to the second end assembly and extending toward the first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of the first and second rotatably fixed and axially movable telescoping rods in mating engagement with the gear teeth of the rings;

(c) rotation means for rotating the rings with respect to the support members and including first rod rotation means for rotating the first and second rotatably fixed and axially movable telescoping rods;

(d) elongation means for changing the length of the frame, including second rod rotation means for rotating at least one screw-threaded rod; and (e) external control means for controlling movement of the frame in response to a manual input.

The above and other objects, features and advantages of the present invention will become readily apparent from the following detailed description thereof which is to read in connection with the accompanying drawings.

DETAILED DESCRIPTION OF THE PREFERRED EMBODIMENTS

Figure 1:
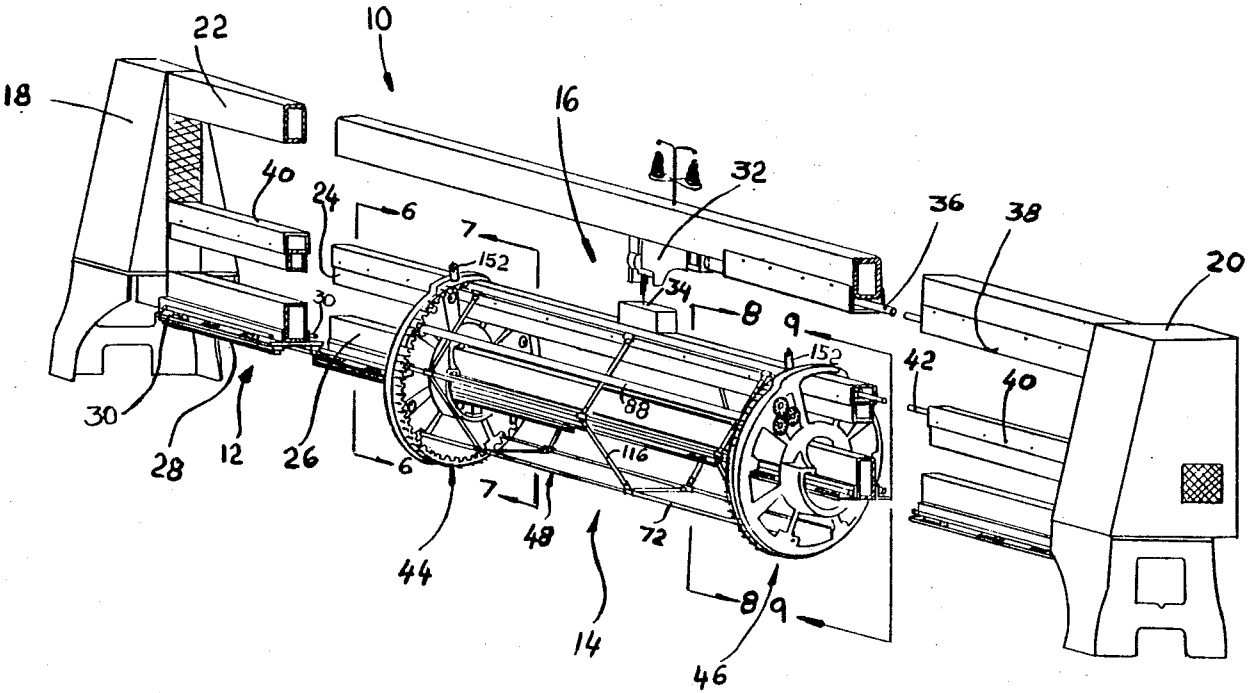
FIG. 1 is a front perspective view of a sewing machine according to the present invention, without the outer covering on the frame.
Figure 2:
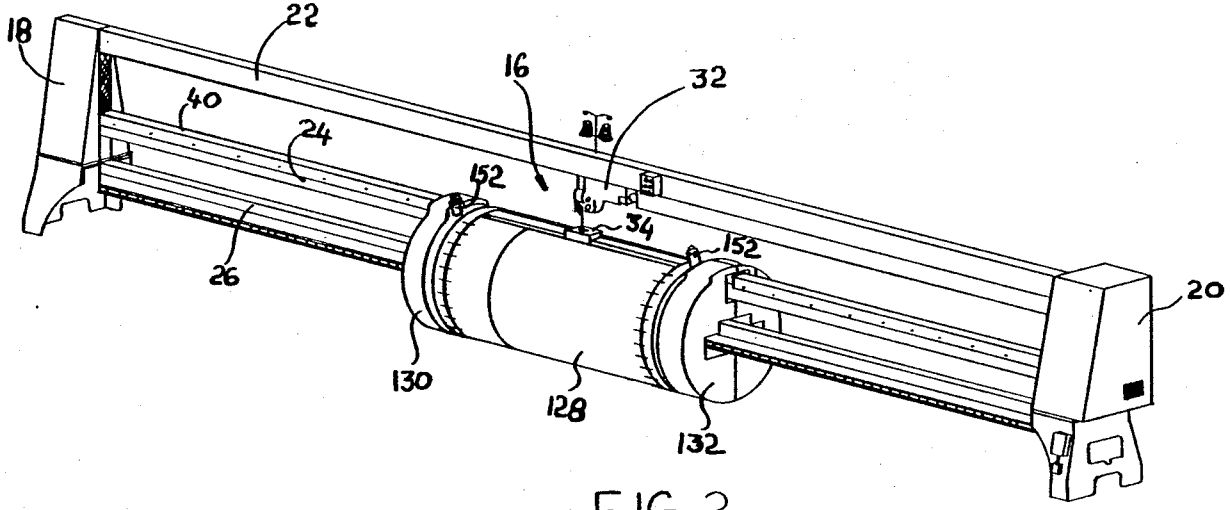
FIG. 2 is a perspective view of the sewing machine of FIG. 1 with the outer covering on the frame.
Figure 3:
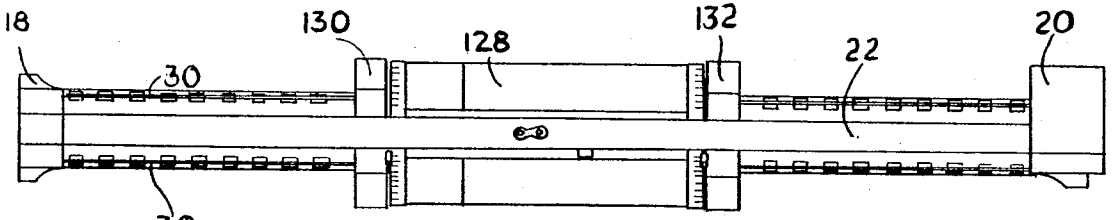
FIG. 3 is a top plan view of the sewing machine of FIG. 2.
Figure 4:
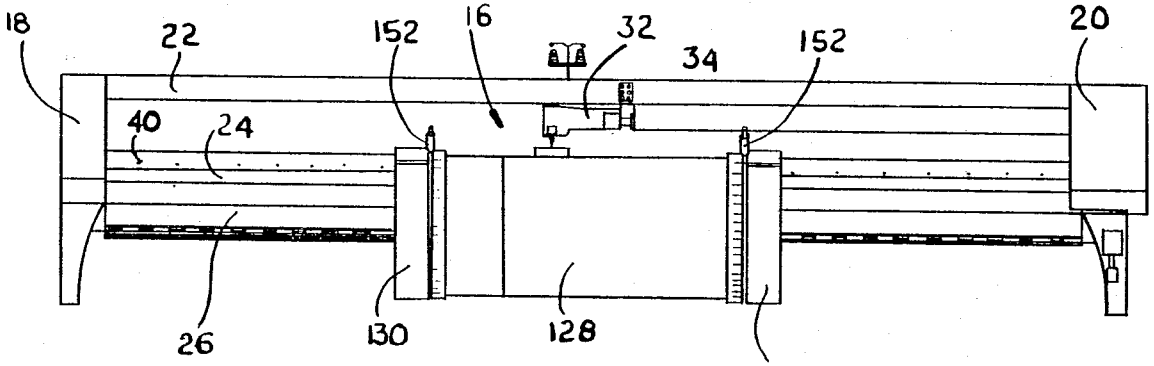
FIG. 4 is a front elevational view of the sewing machine of FIG. 2.
Figure 5:
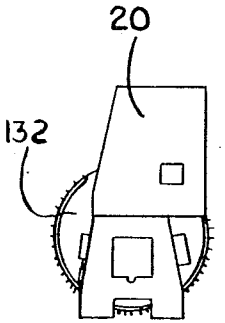
FIG. 5 is an end elevational view of the sewing machine of FIG. 2.

Referring to the drawings in detail, and initially to FIG. 1 thereof, a single needle, computer controlled frame quilting machine 10 according to the present invention generally includes a base 12, a substantially cylindrically shaped frame 14 slidably and rotatably mounted on base 12 and a sewing section 16 mounted on base 12 directly above frame 14.

Specifically, base 12 includes end supports 18 and 20 and an upper horizontal bridge 22, a middle horizontal bridge 24 and a lower horizontal bridge 26, all in substantially vertical alignment, for interconnecting end supports 18 and 20. As shown in the Figures, bridges 22, 24 and 26 may be constructed from beams having a square or rectangular cross-section and which interconnect end supports 18 and 20. As shown in FIGS. 1 and 6–9, base 12 includes L-shaped brackets 28 extending on opposite sides from the lower end of lower bridge 22 and extending outwardly therefrom. A sliding Thomson shaft 30 is secured along the length on the upper surface of the laterally extending leg of each L-shaped bracket 28 for slidably supporting frame 14 thereon, as will be described in greater detail hereinafter.

Sewing machine 16 includes a sewing head 32 secured to the underside of upper bridge 22 and a bobbin 34 secured on top of middle bridge 24 directly under sewing head 32, as is well known in the art. In order to provide control of sewing head 32, a sewing head drive shaft 36 extends from end support 20 into driving engagement with sewing head 32 and is positioned directly beneath upper bridge 22. A U-shaped cover plate 38 is secured to the lower portion of upper bridge 22 so as to define a channel therein through which sewing head drive shaft 36 extends. In like manner, an inverted U-shaped cover plate 40 is secured to the upper portion of middle bridge 24 and defines a channel therein through which a bobbin drive shaft 42 extends from end support 20 into driving engagement with bobbin 34 which is situated on inverted U-shaped cover plate 40. As will be appreciated from the discussion hereinafter, when a fabric is secured to frame 14, the fabric extends over bobbin 34, that is, between the needle of sewing head 32 and bobbin 34 so that a pattern can be sewn thereon. In this regard, bobbin 34 does not extend to a height greater than that of frame 14 to which the fabric is secured.

Frame 14 is generally formed of a first end assembly 44, a second end assembly 46 and transverse rods 48 which interconnect first and second end assemblies 44 and 46. Specifically, first and second end assemblies include support castings 50 and 52, respectively, slidably mounted on Thomson shafts 30 in spaced relation to each other. Support castings 50 and 52 are generally of a circular or ring shaped configuration having a plurality of apertures spaced thereabout so as to define an outer periphery 54, a hub 56 and plurality of spider arms 58 interconnecting hub 56 and outer periphery 54. An inverted T-shaped central opening 60 is provided in hub 56 and defines downwardly facing horizontal shoulders 62 to which Thomson bearings 64 are secured, the latter engaging with Thomson shafts 30 to slidably support castings 50 and 52, and thereby frame 14, on lower bridge 26.

Figure 7:
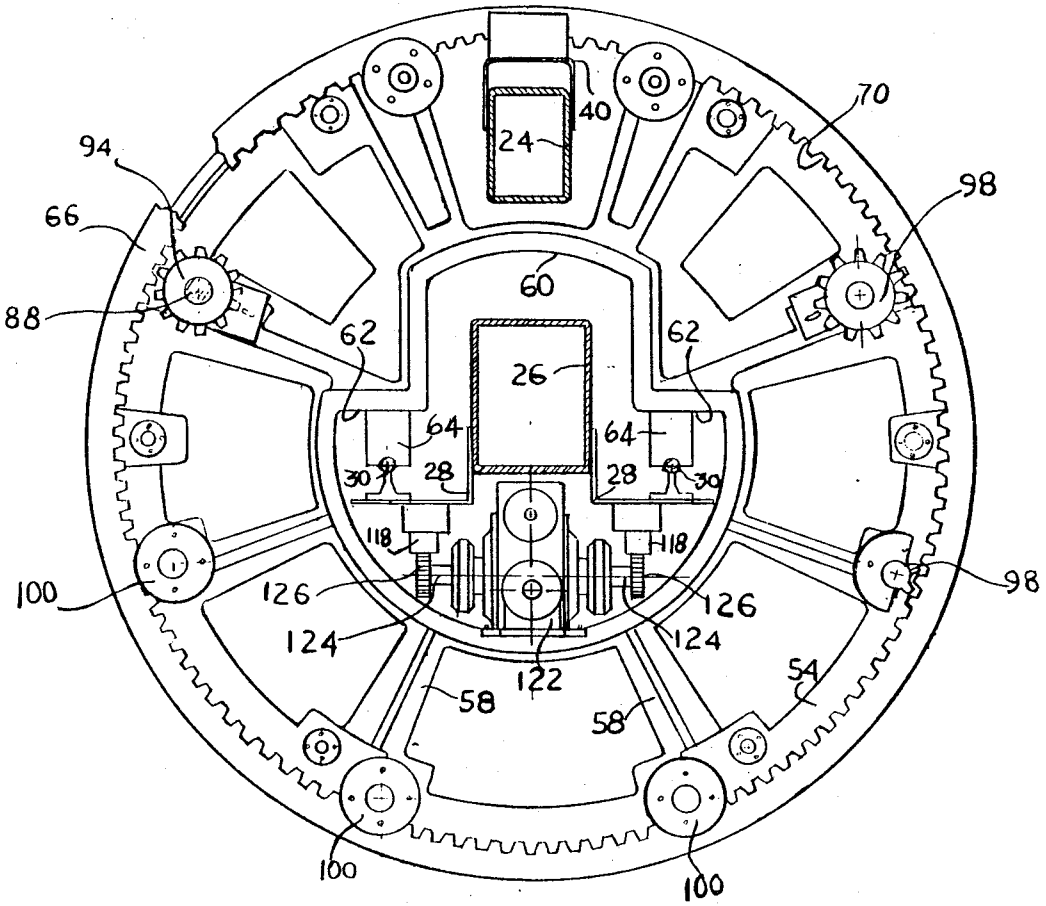
FIG. 7 is a cross-sectional view of the sewing machine of FIG. 1, taken along line 7—7 thereof.
Figure 8:
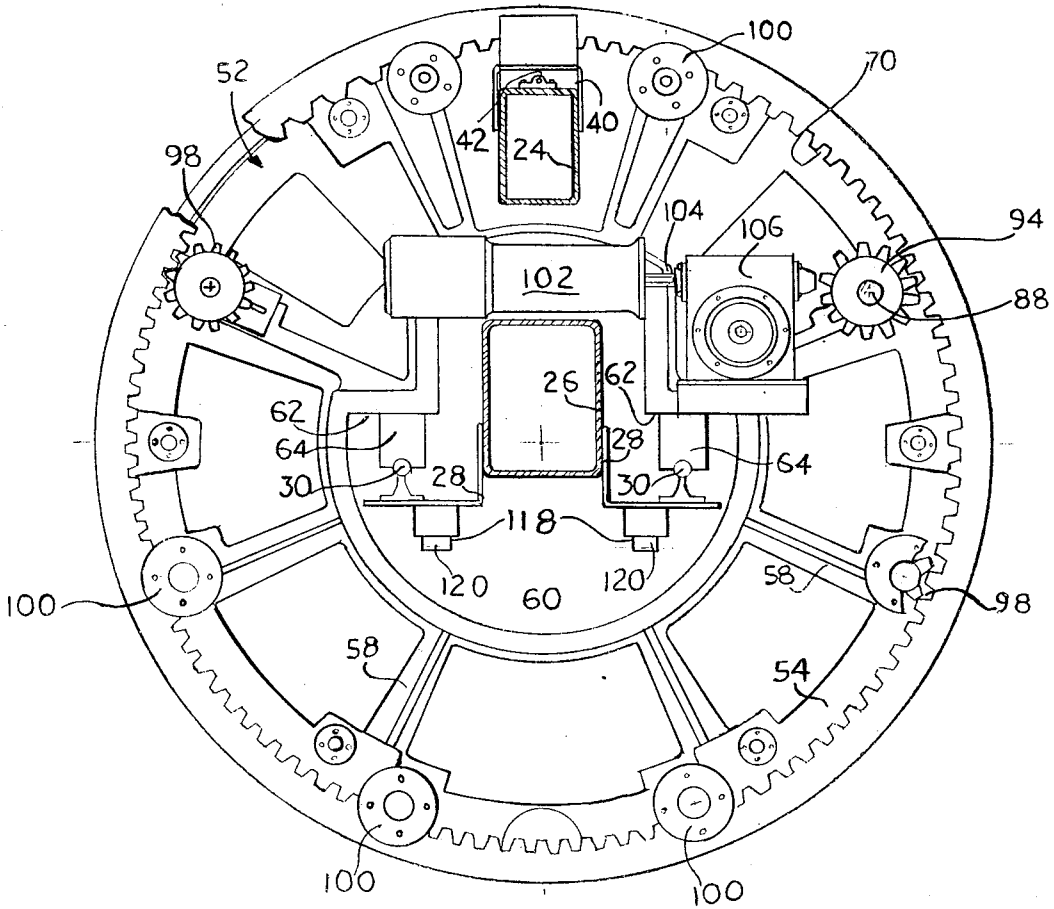
FIG. 8 is a cross-sectional view of the sewing machine of FIG. 1, taken along line 8—8 thereof.
Figure 9:
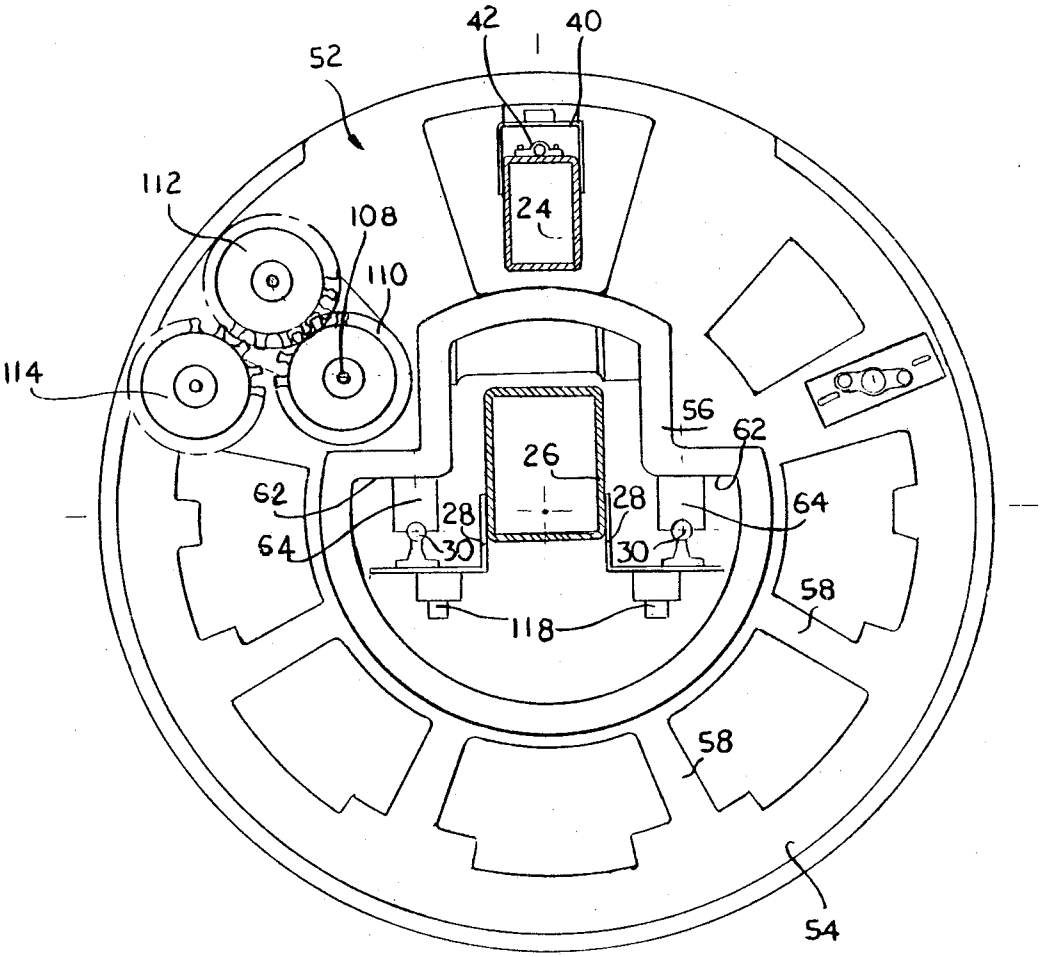
FIG. 9 is a cross-sectional view of the sewing machine of FIG. 1, taken along line 9—9 thereof.

First and second end assemblies 44 and 46 further include inner rings 66 and 68, respectively, which are rotatably mounted to support castings 50 and 52, respectively, as shown in FIGS. 7 and 8. As shown, rings 66 and 68 include gear teeth 70 along the entire inner circumference thereof, by which rings 66 and 68 are supported with respect to the respective castings 50 and 52 and by which frame 14 is rotated, as will be discussed in greater detail hereinafter.

Figure 10:
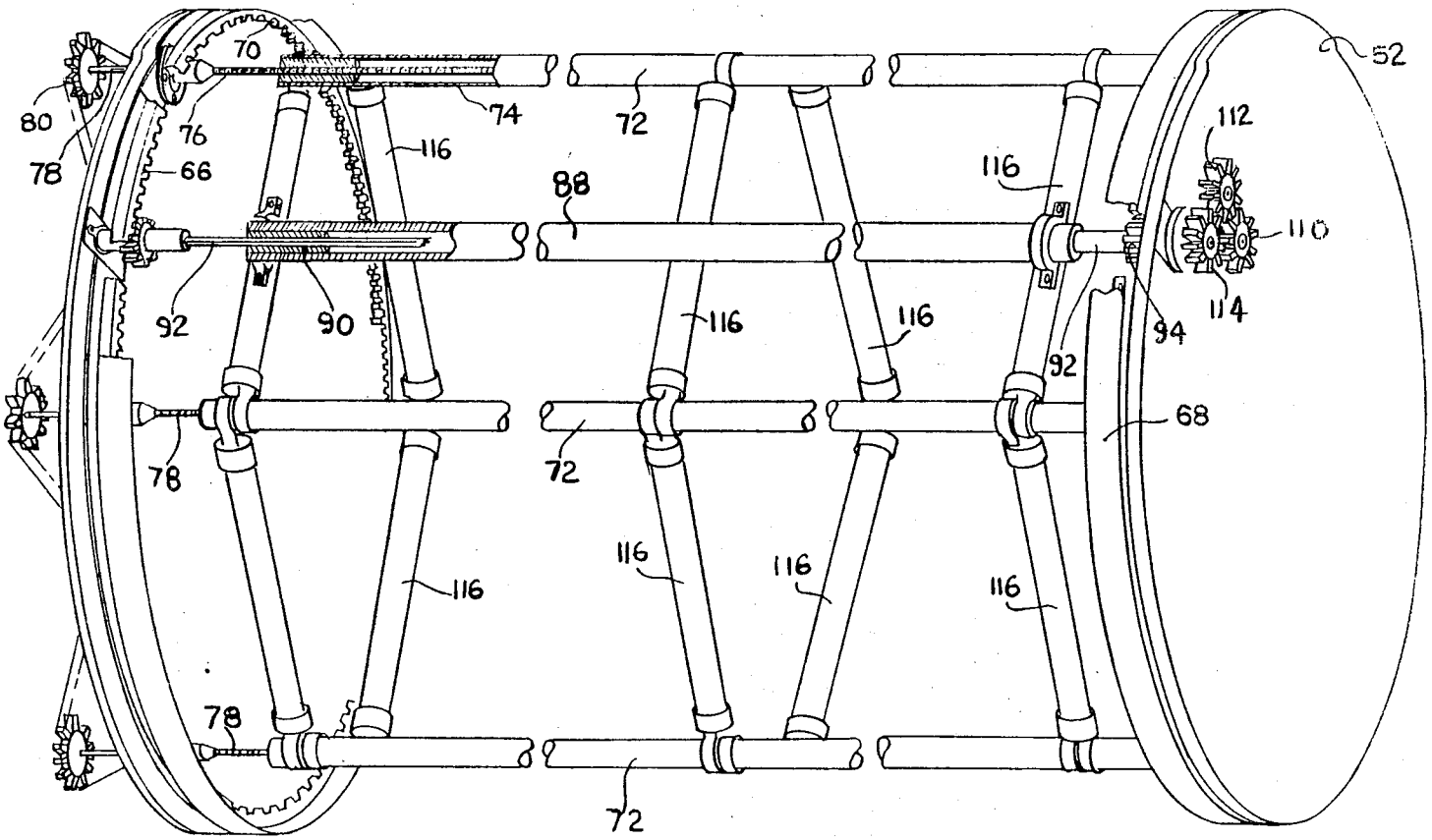
FIG. 10 is an enlarged perspective view of the substantially cylindrical frame of the sewing machine of FIG. 1.

As shown in FIGS. 1 and 10, a plurality of longitudinally extending rods 72 are secured to support casting 52 and extend toward support casting 50, but being spaced slightly from inner ring 66. Rods 72 are hollow, as shown in FIG. 10 and include a threaded bushing 74 at the distal ends thereof. A threaded rod 76 is rotatably secured to casting 50 by any suitable means, such as a bearing or the like, and is screw-threadedly received in bushing 74. Thus, as threaded rod 76 is rotated into or out of threaded bushing 74, first and second end assemblies 44 and 46 move toward or away from each other, respectively, to change the length of frame 14. In other words, rods 72 and 76 are telescopically and screw-threadedly connected.

Figure 6:
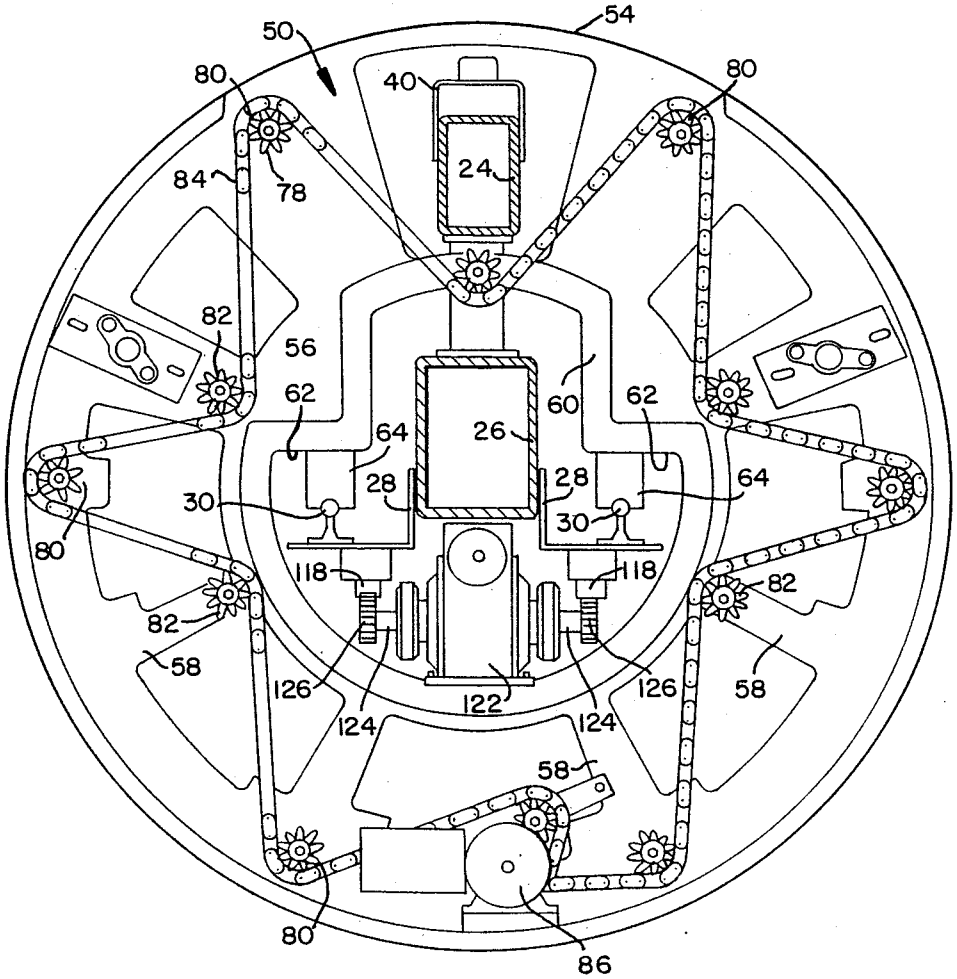
FIG. 6 is a cross-sectional view of the sewing machine of FIG. 1, taken along line 6—6 thereof.

As shown in FIGS. 6 and 10, each threaded rod 76 includes an extension shaft 78 extending through and to the outside of support casting 50. A gear 80 is secured to the end of each extension shaft 78. As illustrated in FIG. 6, gears 80 lie about a common circle having a common center lying on the axis of frame 14. A plurality of idler gears 82 are rotatably secured to the outer end face of support casting 50 and are inwardly spaced in the radial direction from gears 80. A chain 84 is wrapped about gears 80 and idler gears 82, and is driven by a drive motor 86. Thus, as drive motor 86 moves chain 84, gears 80 and threaded rods 78 are caused to rotate, thereby either lengthening or shortening frame 14.

Referring back to FIG. 10, a hollow, main drive rod 88 is rotatably journaled in support casting 52 through a suitable bearing assembly and extends toward support casting 50, but is spaced from inner ring 66. A hex bushing 90 is secured within main drive rod 88 at the distal or free end thereof. A hex rod 92 is rotatably mounted to support casting 50 by a suitable bearing assembly and extends through hex bushing 90. Thus, hex rod 92 is permitted to slide in the axially direction thereof with respect to main drive rod 88 but is rotatably fixed thereto.

A first drive gear 94 is secured to main drive rod 88 in meshing engagement with gear teeth 70 of inner ring 68. In like manner, a second drive gear 96 is secured about hex rod 92 in meshing engagement with gear teeth 70 of inner ring 66. As shown in FIGS. 7 and 8, a plurality of idler gears 98 are rotatably secured to the inner surface of castings 50 and 52 in meshing engagement with the gear teeth 70 of inner rings 66 and 68, respectively, whereby inner rings 66 and 68 are rotatably supported by castings 50 and 52, respectively. A plate 100 is preferably positioned over each idler gear 98, as shown, to prevent relative axial movement between gears 94,96 and 98 with respect to rings 66 and 68. In this regard, as main drive rod 88 is rotated, drive gears 94 and 96 are also rotated, thereby causing rotation of inner rings 66 and 68 about idler gears 98 with respect to castings 50 and 52, respectively.

As shown in FIGS. 1 and 8–10, a motor 102 is secured to the inner face of support casting 52 and has an output drive shaft 104 connected to a gear reducer 106. Gear reducer 106 includes an output drive shaft 108 extending to the outside of support casting 52 and including a gear 110 secured thereon Gear 110 rotatably meshes with an idler gear 112 rotatably mounted on the outer surface of support casting 52, and idler gear 112 rotatably meshes with a gear 114 secured on main drive rod 88 extending to the outside of support casting 52. Thus, as output drive shaft 108 from gear reducer 106 rotates, main drive rod 88 is caused to rotate through gears 110, 112 and 114, thereby causing rotation of inner rings 66 and 68 with respect to support castings 50 and 52, respectively.

As shown in FIGS. 1 and 10, in order to provide increased stability to frame 14, a plurality of transverse connecting rods 116 interconnect main drive rod 88 and rods 72.

Figure 11:
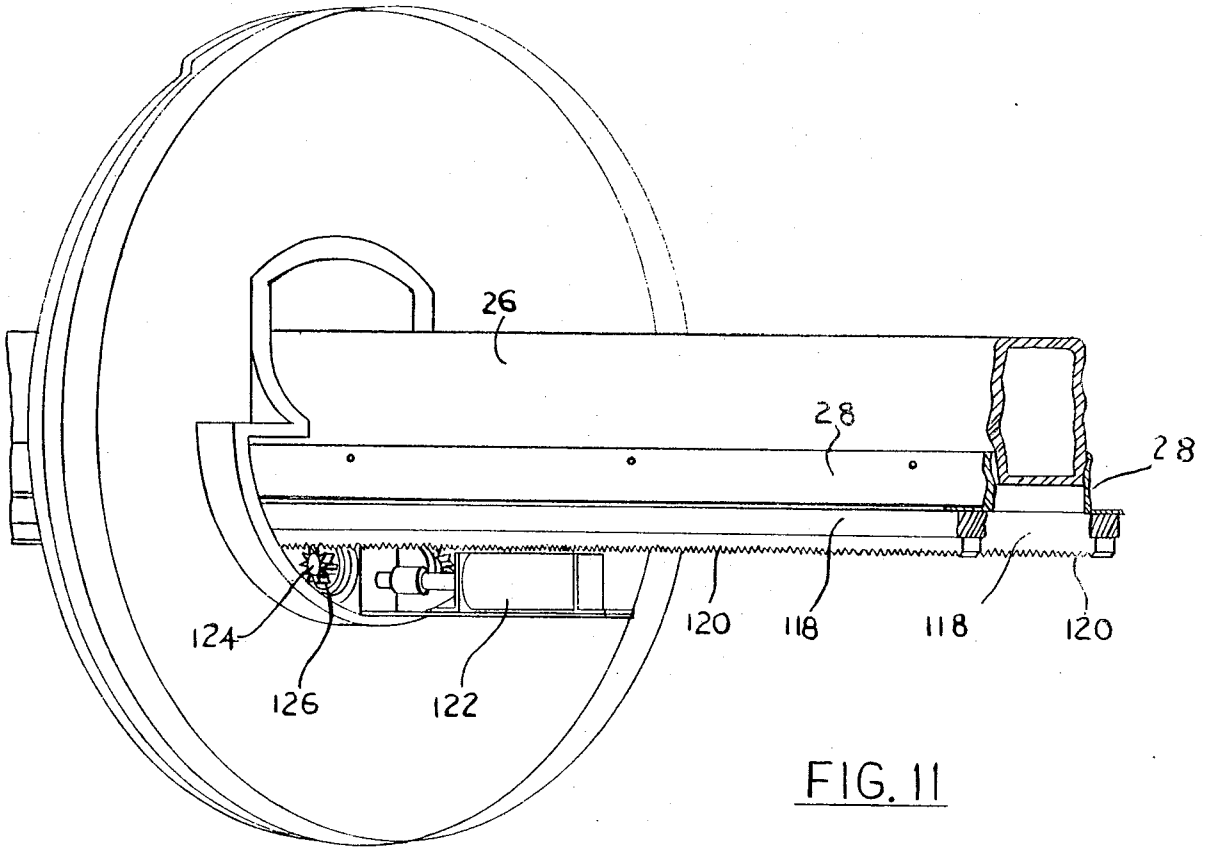
FIG. 11 is an enlarged perspective view of a portion of the sewing machine of FIG. 1, illustrating the rack and pinion arrangement for axially moving the frame along the base.

Referring now to FIGS. 6, 7 and 11, a mechanism for longitudinally driving frame 14 along base 12 will now be described. As shown, a rack 118 is secured to the underside of L-shaped brackets 28, each rack extending along the length of base 12 and having gear teeth 120 extending along the lower surface thereof. A linear drive motor 122 is mounted to support casting 50 and includes oppositely directed output drive shafts 124. A gear 126 is secured to the free end of each output drive shaft 124 in meshing engagement with gear teeth 120 of a respective rack 118, as shown. Thus, as output shafts 124 are rotated, gears 126 are caused to mesh with and move longitudinally with respect to racks 118 to thereby move frame 14 longitudinally along base 12.

With the arrangement thus far described, it is clear that inner rings 66 and 68 can rotate with respect to base 12, frame 14 can be moved longitudinally along base 12 and frame 14 can be either lengthened or shortened. Further, the rack and pinion assembly for longitudinally moving frame 14 along base 12 provides a novel arrangement according to the present invention.

As shown in FIGS. 2–5, frame 14 is preferably covered with a skin 128 of sheet metal or the like which, for example, can be secured to rods 72 by skin mounting spacers (not shown). In addition, left and right guards 130 and 132 can be placed over first and second end assemblies 44 and 46, respectively, to ensure that the internal mechanisms of frame 14 are protected.

Figure 12:
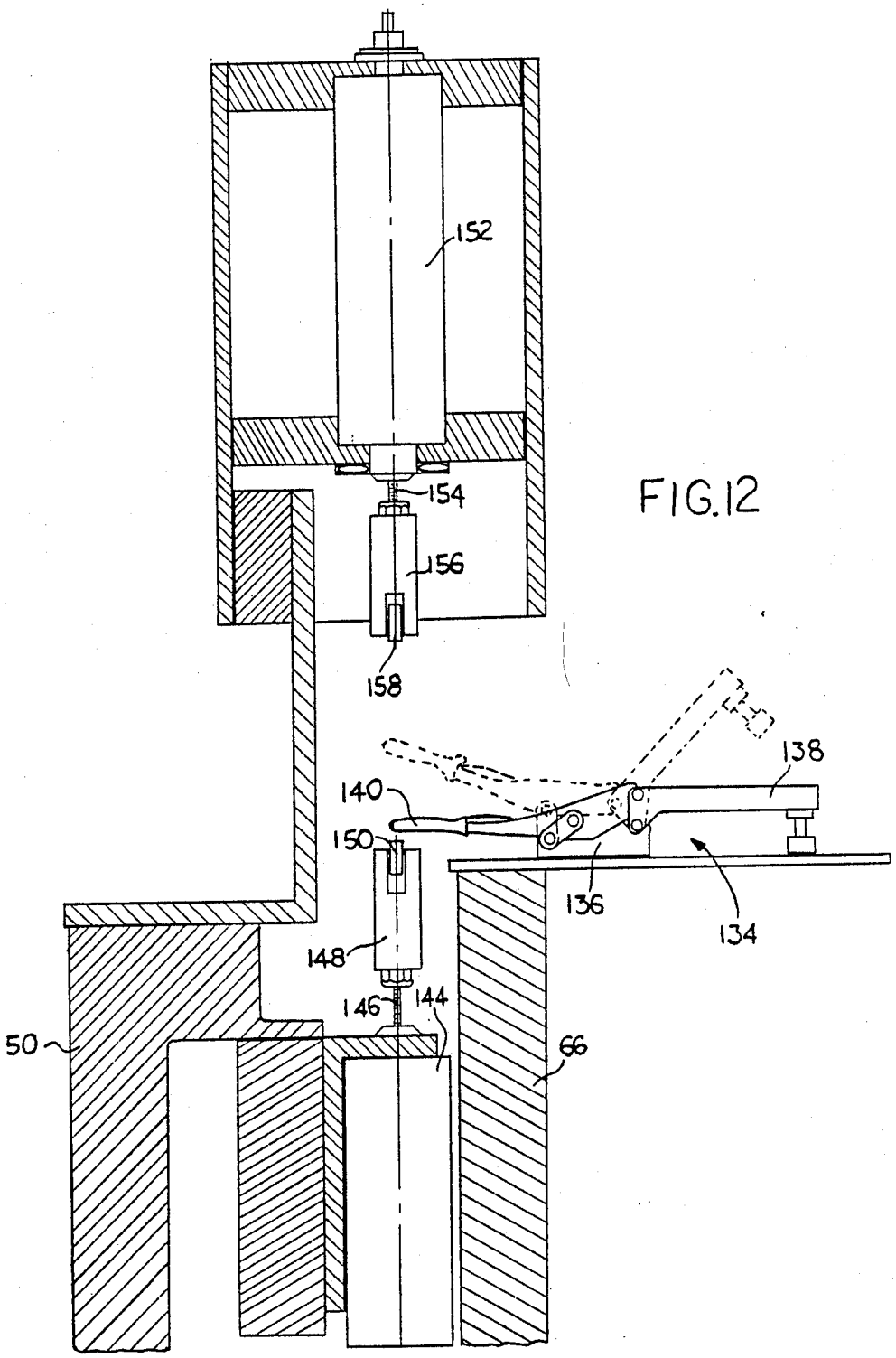
FIG. 12 is an enlarged cross-sectional view of a portion of the sewing machine of FIG. 1, illustrating the clamping assembly for clamping the fabric to the rings of the frame.

Referring now to FIG. 12, a clamping assembly for clamping the fabric to frame 14 will now be described. In FIG. 12, support casting 50 and inner ring 66 are shown schematically in order to better illustrate the clamping mechanism.

Specifically, a plurality of clamps 134, for example, sold by Lapeer Manufacturing Corp. of Lapeer, Mich. under Model No. KNU-VISE H-200 are mounted on the outer circumference of inner rings 66 and 68 and are thereby rotatable therewith. Each clamp 134 includes a base 136, a clamping arm 138 and an actuating arm 140, clamping arm 138 and actuating arm 140 being pivotally secured to base 136 such that clamping arm 138 clamps a fabric 142 to the outer circumference of the respective inner ring, as shown in solid lines, when actuating arm 140 is biased downwardly to the solid line position in FIG. 12. When actuating arm 140 is raised to the dashed line position in FIG. 12, clamping arm 138 is likewise raised to the dashed line position to release fabric 142.

In accordance with the present invention, a lower cylinder 144 is secured to the inner surface of each casting 50 and 52 in a space between the casting and its respective inner ring. Each lower cylinder 144 is positioned at the uppermost end of the support casting. A piston 146 is slidably received within lower cylinder 144 and includes a roller support block 148 at its free end, roller support block 148 rotatably supporting a roller 150 at the upper end thereof which is in alignment with the free end of actuating arm 140. In like manner, an upper cylinder 152 secured to each support casting and having a piston 154 extending downwardly therefrom above actuating arm 140, is provided. A roller support block 156 is secured to the free end of piston 154 and rotatably supports a roller 158 thereat. Pistons 146 and 154 may be actuated by any suitable means, but are preferably electrically operated in a solenoid type manner.

With the arrangement describe thus far, when piston 154 is moved downwardly in FIG. 12, roller 158 biases actuating arm to the said line position to clamp fabric 142 between the inner ring and clamping arm 138. When it is desired to release fabric 142, piston 146 is moved upwardly in FIG. 12 to bias actuating arm 140 to the dashed line position so as to release fabric 142.

A plurality of such clamps 134 are periodically spaced on the outer circumference of inner rings 66 and 68. Thus, to secure a fabric 142 about frame 14, the fabric is positioned thereon around inner rings 66 and 68 and the latter are rotated with respect to castings 50 and 52. During such rotation, piston 154 is periodically moved downwardly into engagement with each actuating arm 140 to move the same to the solid line position shown in FIG. 12 to clamp fabric 142 to frame 14. Since inner rings 66 and 68, and thereby actuating arms 140, are rotated, the use of rollers 158 does not hinder movement of the inner rings or damage the actuating arms 140. After fabric 142 has been clamped to frame 14, first and second end assemblies 44 and 46 can be moved outwardly with respect to each other to stretch fabric 142 on frame 14 to remove wrinkles and the like. Then, frame 14 can be moved longitudinally along base 12 and rings 66 and 68 can be rotated with respect to base 12, while stitching fabric 142 with sewing head 32, to provide a distinctive sewn pattern on fabric 142.

Figure 13:
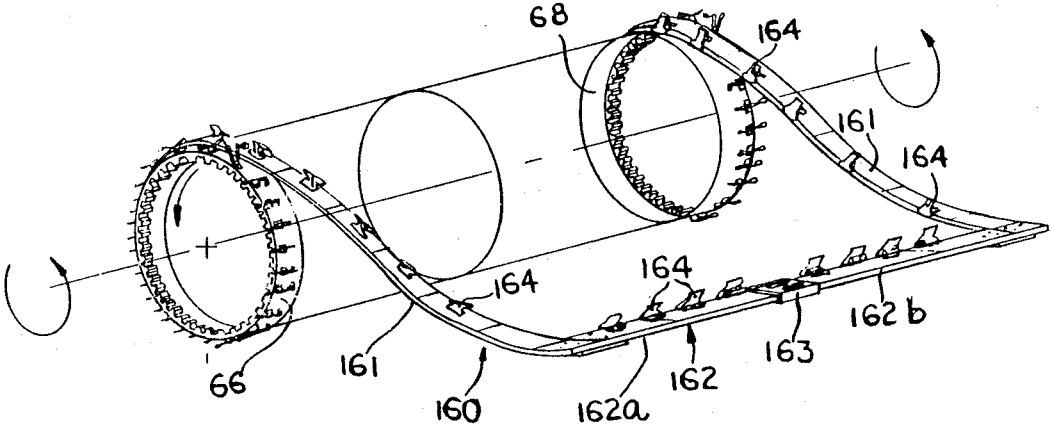
FIG. 13 is a perspective view of a flexible frame for securing the fabric to the substantially cylindrical frame.
Figure 14:
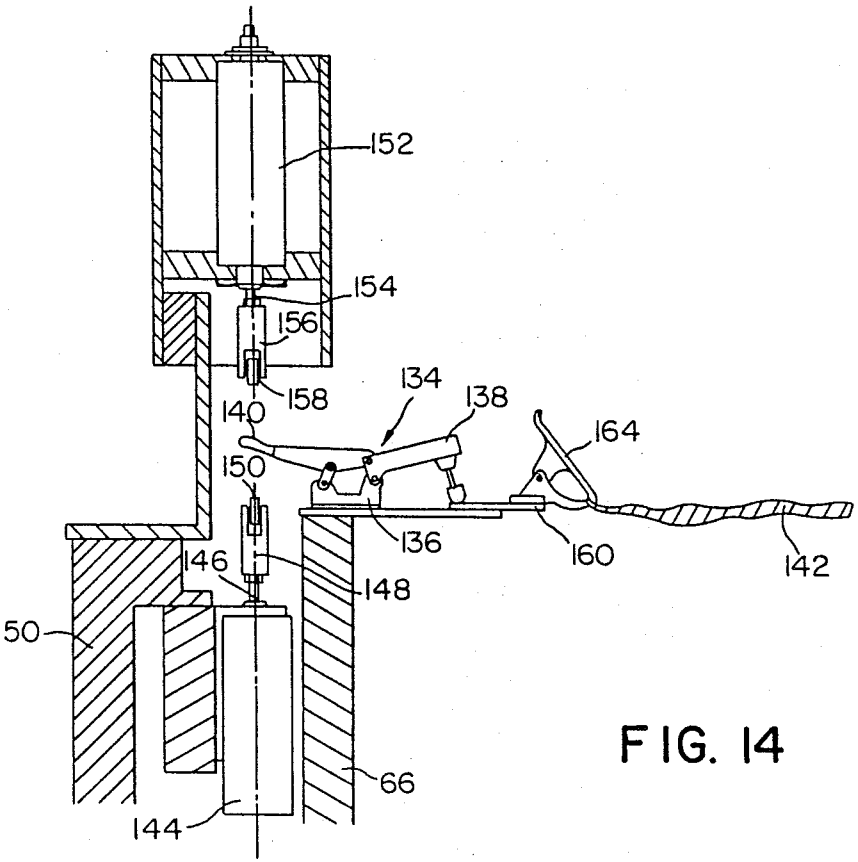
FIG. 14 is a cross-sectional view of a portion of the apparatus of FIG. 1, showing the clamping arrangement for securing the flexible frame of FIG. 13 to the substantially cylindrical frame.
Figure 15:
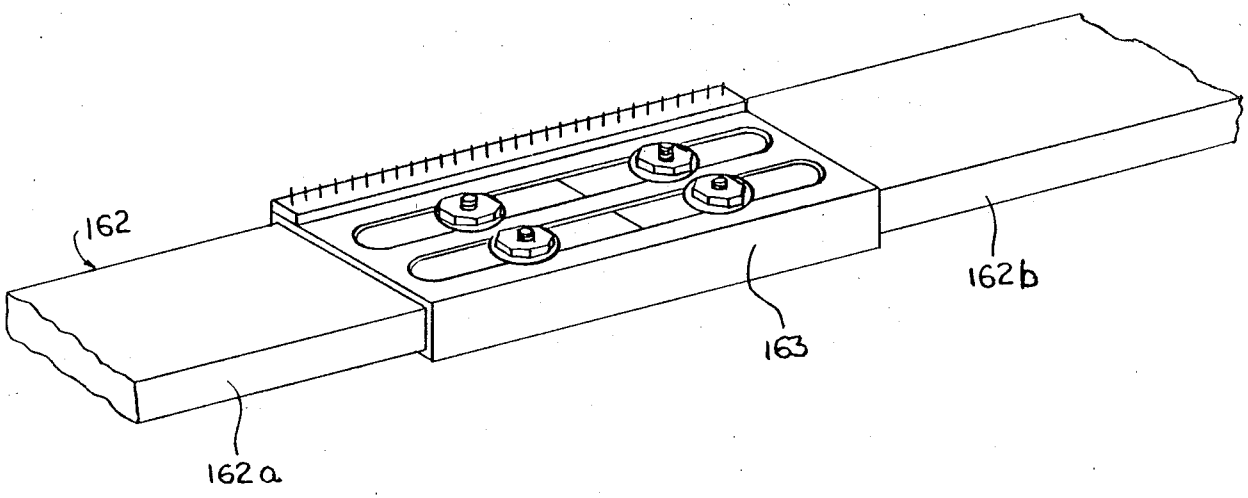
FIG. 15 is a perspective view of a portion of the flexible frame of FIG. 13.

Referring now to FIGS. 13–15, there is shown a slight modification of the clamping assembly of FIG. 12. Specifically, when using the embodiment of FIG. 12, there may be a relatively large amount of down time of the machine due to the necessity to carefully position fabric 142 thereon. In accordance with the embodiment of FIGS. 13 and 14, a flexible frame 160 is provided having flexible side members 161 and rigid steel cross members 162 at opposite ends thereof which are positioned in the longitudinal direction of frame 14. Each cross member 162 is formed by two sections **162*a* and 162*b* which can be telescopically slidable with respect to each other, and are secured together by an extension clamp 163 surrounding both sections 162*a* and 162*b*. Clamp 163 thereby permits adjustment of flexible frame 160** for the particular size of the quilt and to provide extra tension for the final set up.

A plurality of spring closed frame clamps 164 are secured to flexible side members 161 and rigid cross members 162 of flexible frame 160, and open inwardly of such frame. Thus, the fabric 142 is first secured to flexible frame 160 by means of frame clamps 164 without using quilting machine 10. Then, when fabric 142 is stretched between frame clamps 164, flexible frame 160 is positioned on the outer circumference of inner rings 66 and 68, and such flexible frame 160 is automatically clamped and rotated with inner rings 66 and 68, thereby greatly reducing the down time of quilting machine 10. Thus, flexible frame 160 enables handling of, for example, 144 inch goods around frame 14, with quick and easy mounting thereof. Further, since the goods can be framed while the machine is operating on another job, down time of the machine is substantially reduced.

Figure 16:
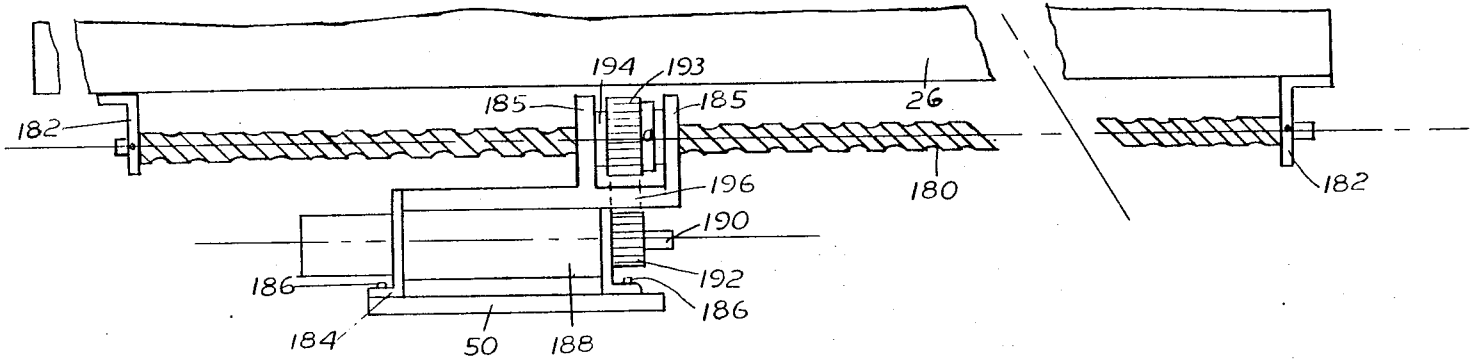
FIG. 16 is a schematic elevational view of a lead screw driving assembly for moving the frame longitudinally with respect to the base.

Referring now to FIG. 16, a lead screw drive mechanism for longitudinally driving frame 14 along base 12 in an alternative manner will now be described. As shown, a helical lead screw 180 is connected to the underside of lower bridge 26 by L-shaped brackets 182 at opposite ends thereof, such that helical lead screw 180 extends along the length of base 12.

A mounting frame 184 is secured to support casting 50 beneath lead screw 180, by bolts 186 or the like. Mounting frame 184 supports a drive motor 188 having an output shaft 190. A first timing pulley pinion 192 is mounted to output shaft 190. As shown, the upper end of mounting frame 184 is bifurcated at a position 185 above first timing pulley pinion 192 so as to rotatably support therein a second timing pulley pinion 193 and a ball bearing drive 194 secured to second timing pulley pinion 192 for rotation therewith. A timing belt 196 surrounds first and second timing pulley pinions 192 and 193. As a result, rotation of output shaft 190 results in rotation of ball bearing drive 194 through first and second timing pulley pinions 192 and 193 and timing belt 196.

Lead screw 180 extends through the bifurcated portion of mounting frame 184, second timing pulley pinion 193 and ball bearing drive 194. Ball bearing drive 194 is of the type having a plurality of ball bearings situated within the helical groove of lead screw 180 so that rotation of ball bearing drive 194 causes mounting frame 184 and support casting 50 to move longitudinally along lead screw 180. Ball bearing drive 194 is a conventional ball bearing screw drive, for example, sold under Model R-1501 by Warner Electric Brake and Clutch Company of South Beloit, Ill. As a result, rotation of motor output shaft 190 results in support casting 50, and thereby frame 14, being moved longitudinally along base 12.

Figure 16A:
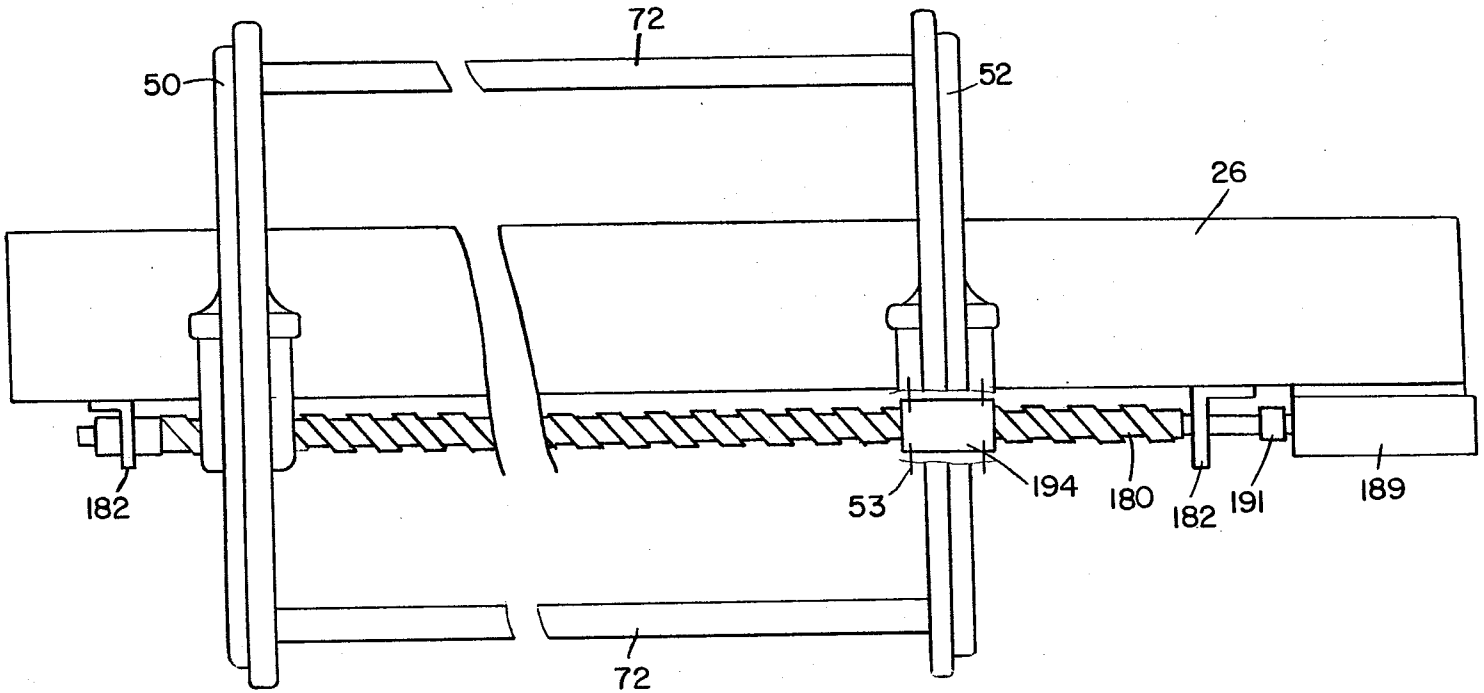
FIG. 16A is a schematic elevational view of another lead screw driving assembly for moving the frame longitudinally with respect to the base.

Although the embodiment of FIG. 16 showns lead screw 180 to be stationary, alternatively, ball bearing drive 194 could be stationary and connected to support casting 52 through a ball mounting bracket 53, as shown in FIG. 16A.

In such case, lead screw 180 would have to be rotated by a drive motor 189 through a coupling 191. The embodiment of FIG. 16, however is preferred, due to possible problems of inertia of a rotating lead screw 180. In any event, the present invention envisions both embodiments.

Figure 17:
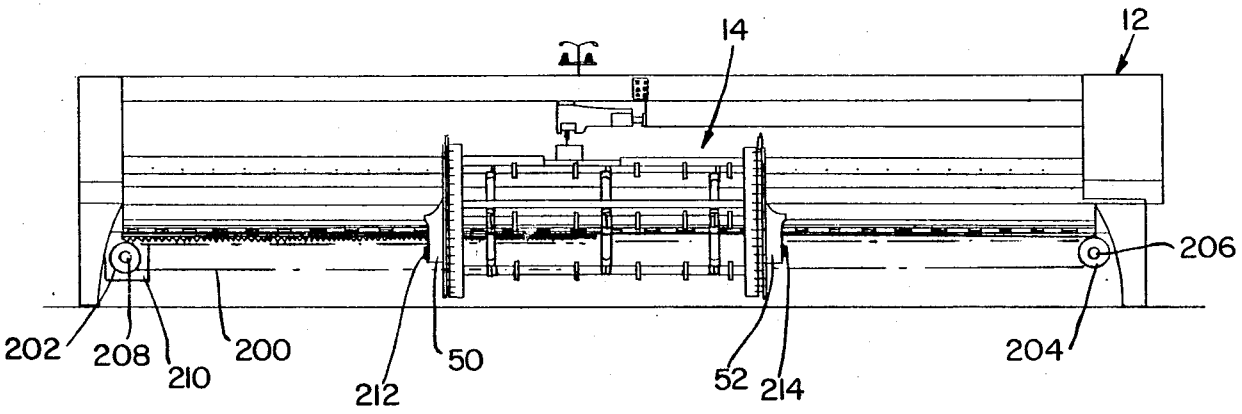
FIG. 17 is an elevational view of a belt drive assembly for moving the frame longitudinally along the base.

Referring now to FIG. 17, a belt drive mechanism for longitudinally driving frame 14 along base 12 accoring to another embodiment of the invention will now be described. As shown, a drive belt 200 which is made of any suitable webbing or like material is wound about two rollers 202 and 204 at opposite ends of the apparatus. Roller 204 is mounted on a shaft 206 for free rotation, while roller 202 is mounted on an output shaft 208 of a drive motor 210. Thus, drive motor 210 functions to move drive belt 200 over rollers 202 and 204. Drive belt 200 is connected, in one embodiment, to a single support casting 50 or 52 by any conventional means. Thus, as belt 200 is driven over rollers 202 and 204, frame 14 is caused to move longitudinally with respect to base 12. The reason for attaching belt 200 to only one support casting is to enable frame 14 to expand longitudinally.

Alternatively, belt 200 can be secured to both support castings 50 and 52. In such case, belt 200 would, for example, be connected directly to support casting 52 and to a winch (not shown) connected to support casting 50. The winch can be a conventional winch, such as a spur gear hand winch, an electric AC winch or a 12 volt DC winch, all sold by McMaster-Carr of Chicago, Ill. The winch provides for expansion and/or contraction of drive belt 200 to compensate for expansion and/or contraction of frame 14 in the longitudinal direction thereof.

In addition, in the embodiment of FIG. 17, two transducers 212 and 214 are provided, transducer 212 be connected to support casting 50 and transducer 214 being connected to support casting 52. The transducers can be any suitable transducers, such as Hall-effect transducers, phototransistors or the like which are associated with suitable magnetic, light blocking or the like spacings along lower bridge 26. Transducers 212 and 214 are preferably spaced 90° out of phase with respect to each other so that both the speed and direction of movement of frame 14 along base 12 can be detected, the manner of doing so being well known.

Figure 18:
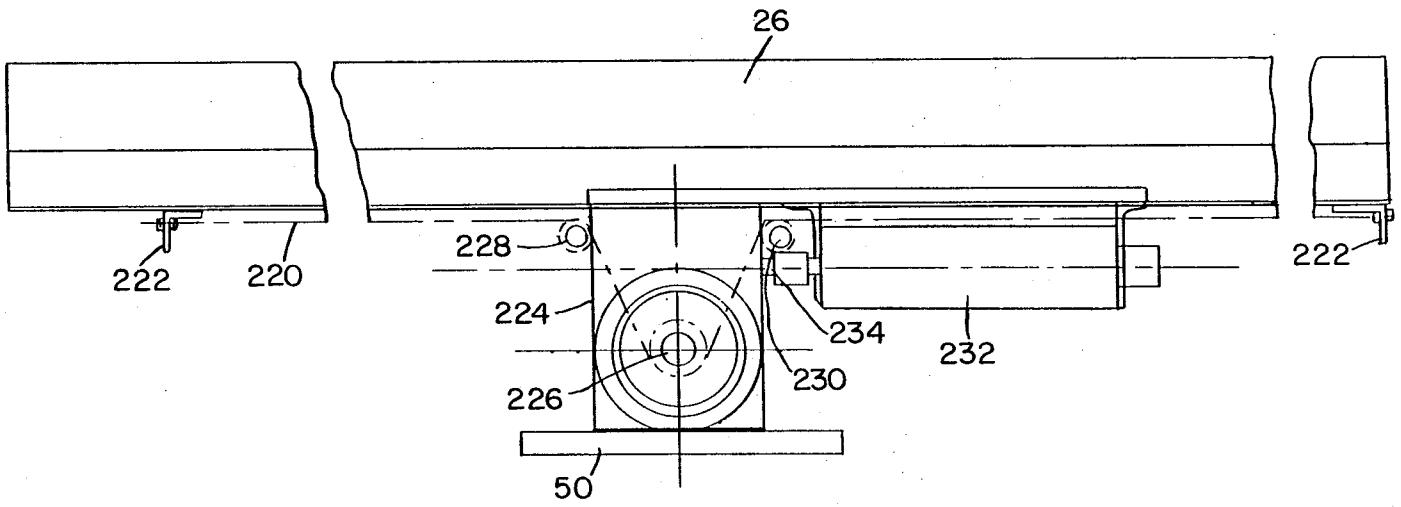
FIG. 18 is an elevational view of a chain drive assembly for moving the frame longitudinally with respect to the base.

As another embodiment of an alternate mechanism for longitudinally driving frame 14 along base 12, reference will now be made to the chain drive mechanism of FIG. 18. The chain drive mechanism of FIG. 18 is similar to the lead screw mechanism of FIG. 16. Specifically, a drive chain 220 is connected between opposite ends of lower bridge 26 by means of L-shaped brackets 222. A gear box 224 having an output drive gear 226 is mounted on support casting 50 and is movable therewith. The portion of drive chain 220 that extends between brackets 222 is guided about output drive gear 226 by idler gears 228 and 230 mounted to gear box 224 for free rotational movement. Thus, as output drive gear 226 rotates, it rides along chain 220, thereby causing frame 14 to move longitudinally with respect to base 12. Output drive gear 226 is driven through a plurality of gears by a drive motor 232 connected at the upper end of gear box 224 and movable therewith. Specifically, output shaft 234 of drive motor 232 is connected to an input gear (not shown) of gear box 224 in order to drive output drive gear 226. In this regard, the embodiment of FIG. 18 operates in a similar manner to the lead screw mechanism of FIG. 16.

Figure 19:
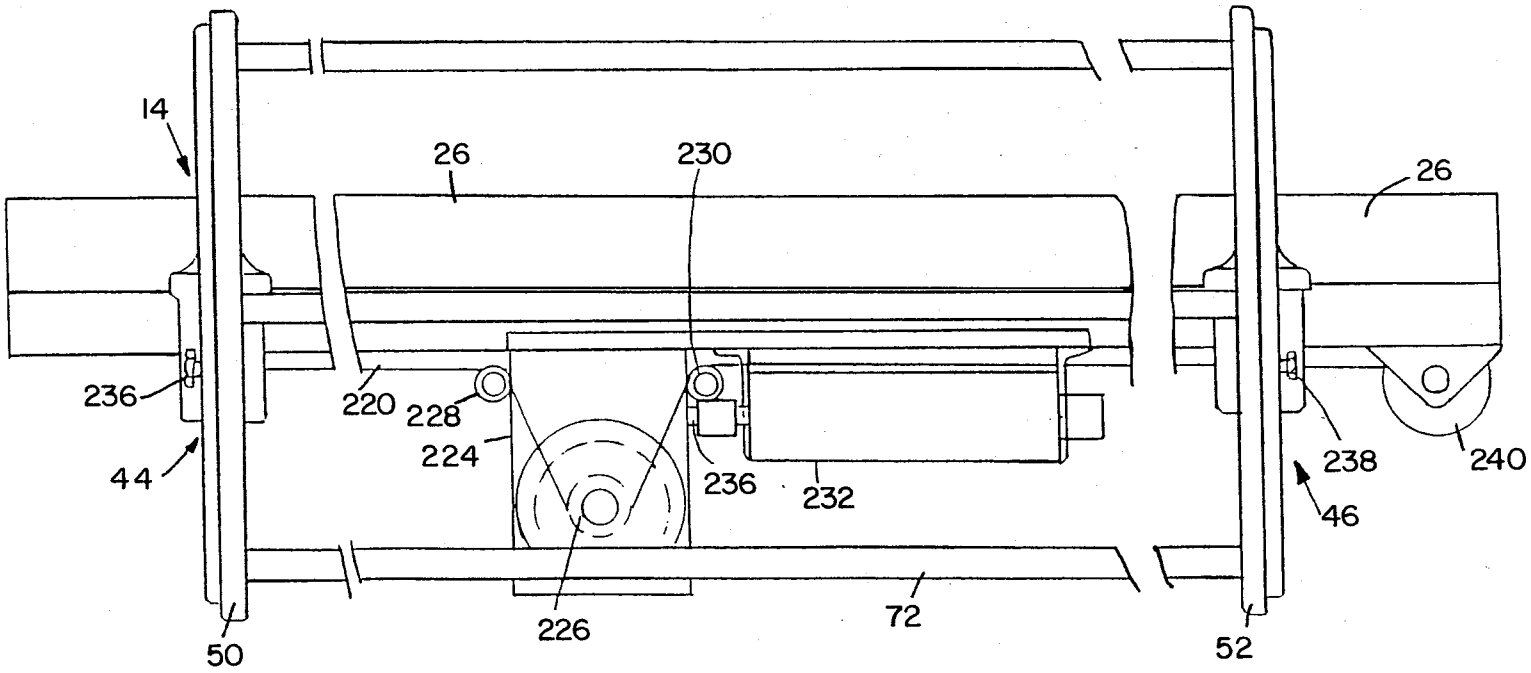
FIG. 19 is an elevational view of another chain drive assembly for moving the frame longitudinally with respect to the base.

Alternatively, as shown in FIG. 19, gear box 224 and drive motor 232 can be connected directly to lower bridge 26 so as to be stationary. In this embodiment, one end of drive chain 220 is connected to first end assembly 44 by means of a screw-threaded locking nut 236 and is connected to second end assembly 46 by another screw-threaded locking nut 238. From screw-threaded locking nut 238, drive chain 220 extends to a take-up roller 240 which is spring biased to exert a tension force on drive chain 220. Thus, this embodiment presents the reverse of that shown in FIG. 18. Specifically, in this embodiment, rotation of output drive gear 226 causes drive chain 220 to be driven longitudinally with respect to stationary lower bridge 26 and stationary gear box 224. As a result, frame 14 is caused to move longitudinally with respect to base 12. Spring biased take-up roller 240 always maintains drive chain taut between screw-threaded locking nut 238 and take-up roller 240. In addition, take-up roller 240 provides for adjustment of drive chain 220 during expansion and/or contraction of frame 14 in the longitudinal direction thereof. Thus, for example, when frame 14 is expanded, screw-threaded locking nut 238 is turned to release drive chain 220 at second end assembly 46. Take-up roller 240 accounts for variations during such expansion. When the desired length of frame 14 is achieved, screw-threaded locking nut 238 is once again tightened to permit lengthwise movement of frame 14 with respect to base 12. Take-up roller 240 can be a conventional spring return reel, such as that sold by McMaster-Carr of Chicago, Ill.

Thus, the above-described embodiment of FIGS. 16–19 describe alternative structures for moving frame 14 longitudinally with respect to base 12.

With sewing machines of the above-described type having a cylindrical frame, the fabric is stretched on the frame. During travel of the frame with respect to the base, the fabric moves with the frame. However, the fabric is also positioned over a bobbin. Thus, during movement of the frame, there is friction between the fabric and the bobbin. Thus, during a change in the rotational direction of the frame, the fabric at the ends of the frame move before the fabric at the center of the frame. Thus, there is a lag in movement of the fabric at the center of the frame. This results in misalignment of the sewing pattern on the fabric.

Figure 20:
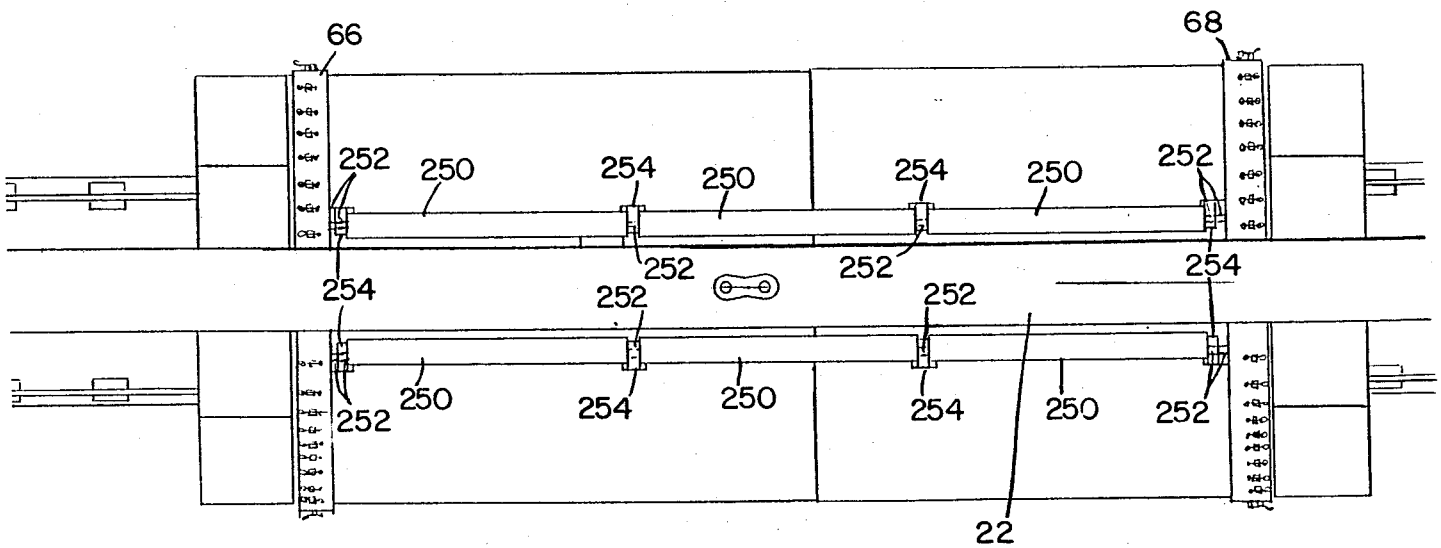
FIG. 20 is a top plan view of the apparatus of FIG. 1, modified by a friction roller assembly.
Figure 21:
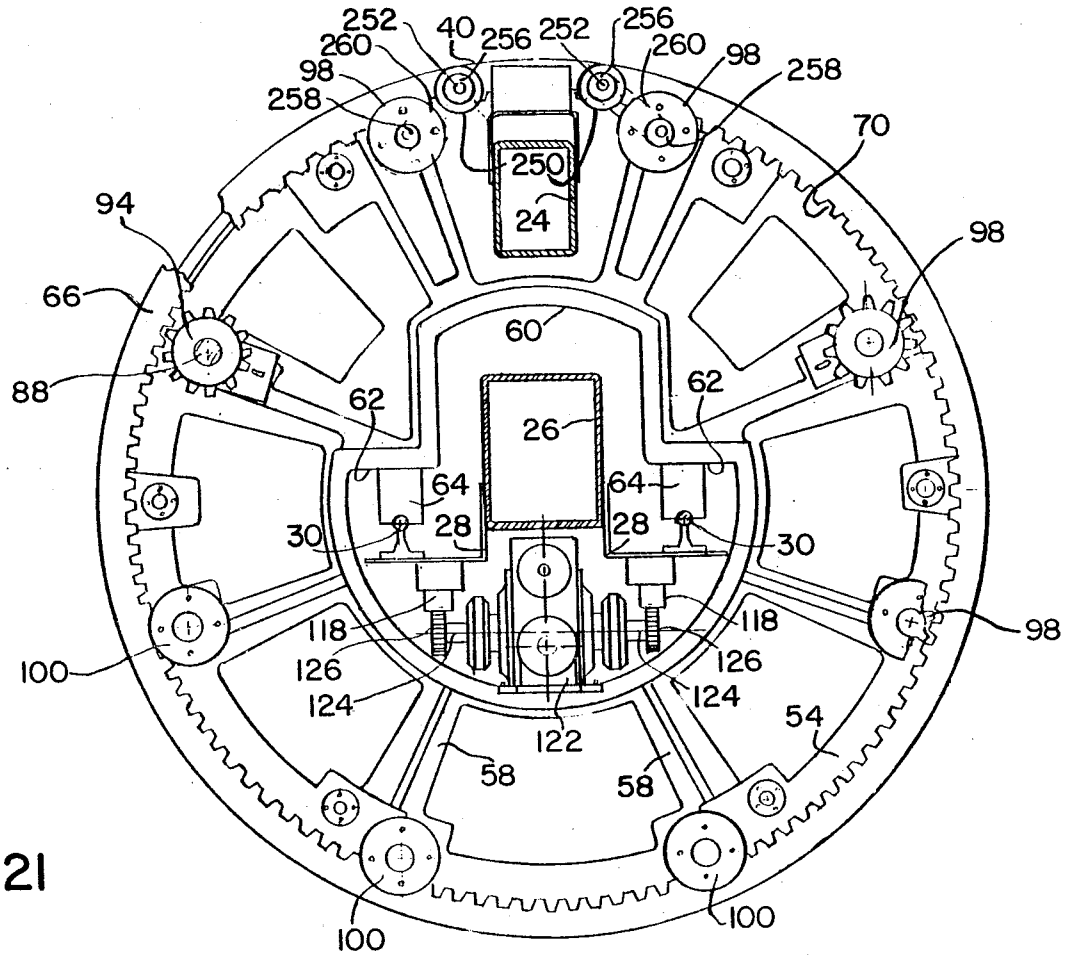
FIG. 21 is an end cross-sectional view of the apparatus of FIG. 20, showing the drive mechanism for the friction rollers.
Figure 22:
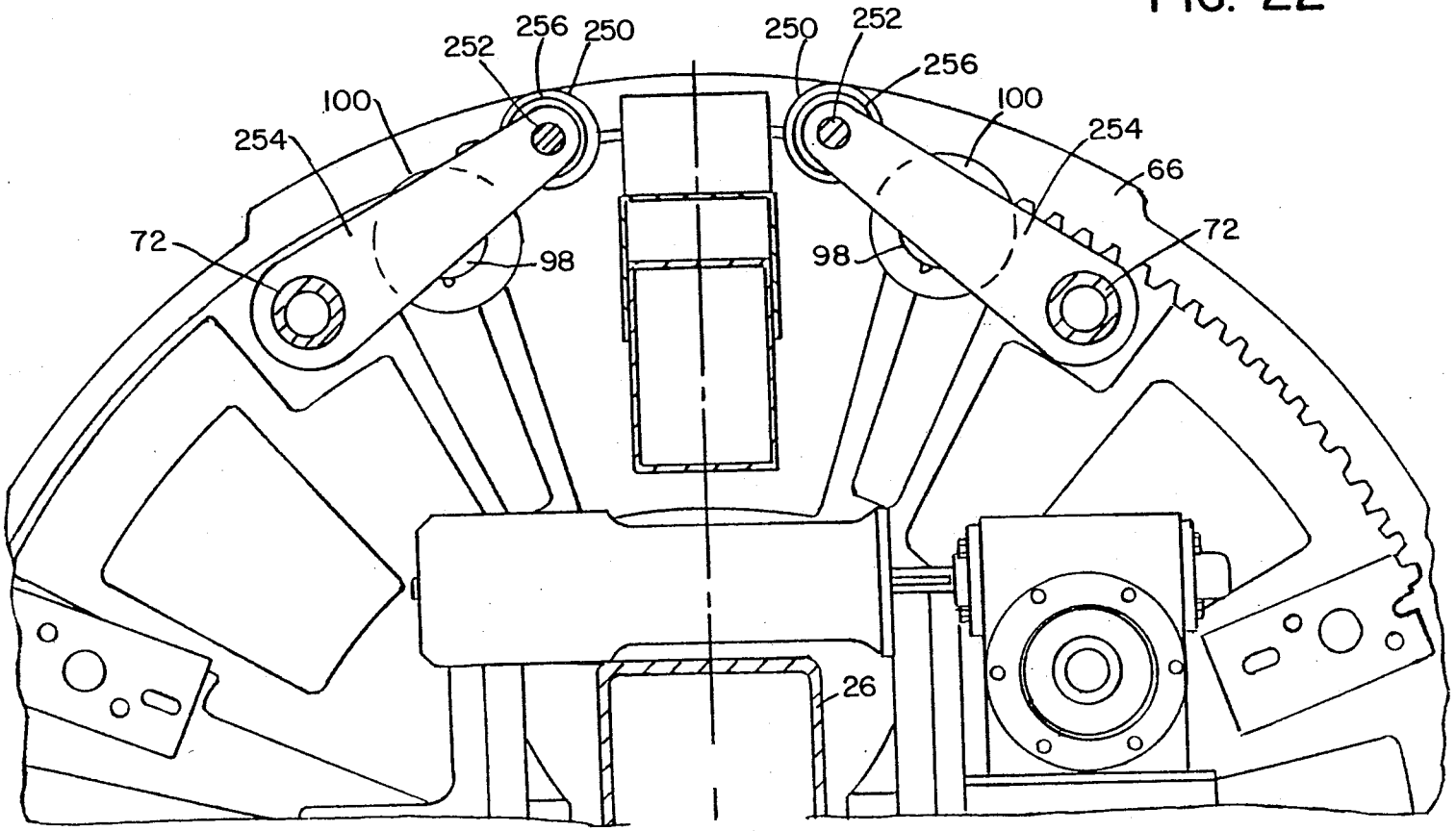
FIG. 22 is an enlarged end cross-sectional view of FIG. 21, showing the support assembly for the friction rollers.

In accordance with another aspect of the present invention, with reference to FIGS. 20–22, friction rollers 250 are positioned at the upper end of frame 14 on opposite sides of upper and middle horizontal bridges 22 and 24. Specifically, a plurality, for example, three, friction rollers 250 are supported in series on each side of bridge 24, as shown in FIG. 20. Friction rollers 250 are arranged in the aforementioned serial manner on a roller support shaft 252 extending through friction rollers 250 and extend out of opposite ends thereof. In this relationship, there is a slight space provided between the ends of the serially arranged friction rollers 250 in each row. In these spaces and at the ends of the rollers, roller support shaft 252 is exposed and is rotatably supported by a plurality of elongated roller brackets 254 (FIG. 22), the opposite ends of roller support brackets 254 being fixedly secured about a respective rod 72. Thus, friction rollers 240 are maintained in the relationship shown in FIGS. 20–22.

A driven timing pulley 256 is secured at each end of roller support shaft 252, and a pinion timing pulley 258 is secured to the same shaft as idler gears 98 at the upper end of frame 14, for rotation with idler gears 98. Timing pulleys 256 and 258 preferably have the same diameter so that there is a 1:1 ratio therebetween. A timing belt 260 extends about timing pulleys 256 and 258. Thus, as idler gears 98 are rotated, pinion timing pulley 258 rotates driven timing pulley 256 through timing belt 260. As a result, roller support shaft 252 and friction rollers 250 are rotated in correspondence with rotation of idler gears 98.

The outer surfaces of friction rollers 250 are at the same height as inner rings 66 and 68. Because of the rotation of friction rollers 250, there is no lag in the center of the fabric with respect to the ends of the fabric as the fabric travels over the bobbin. In addition, any pleats formed in the backside of the fabric are removed.

Figure 23:
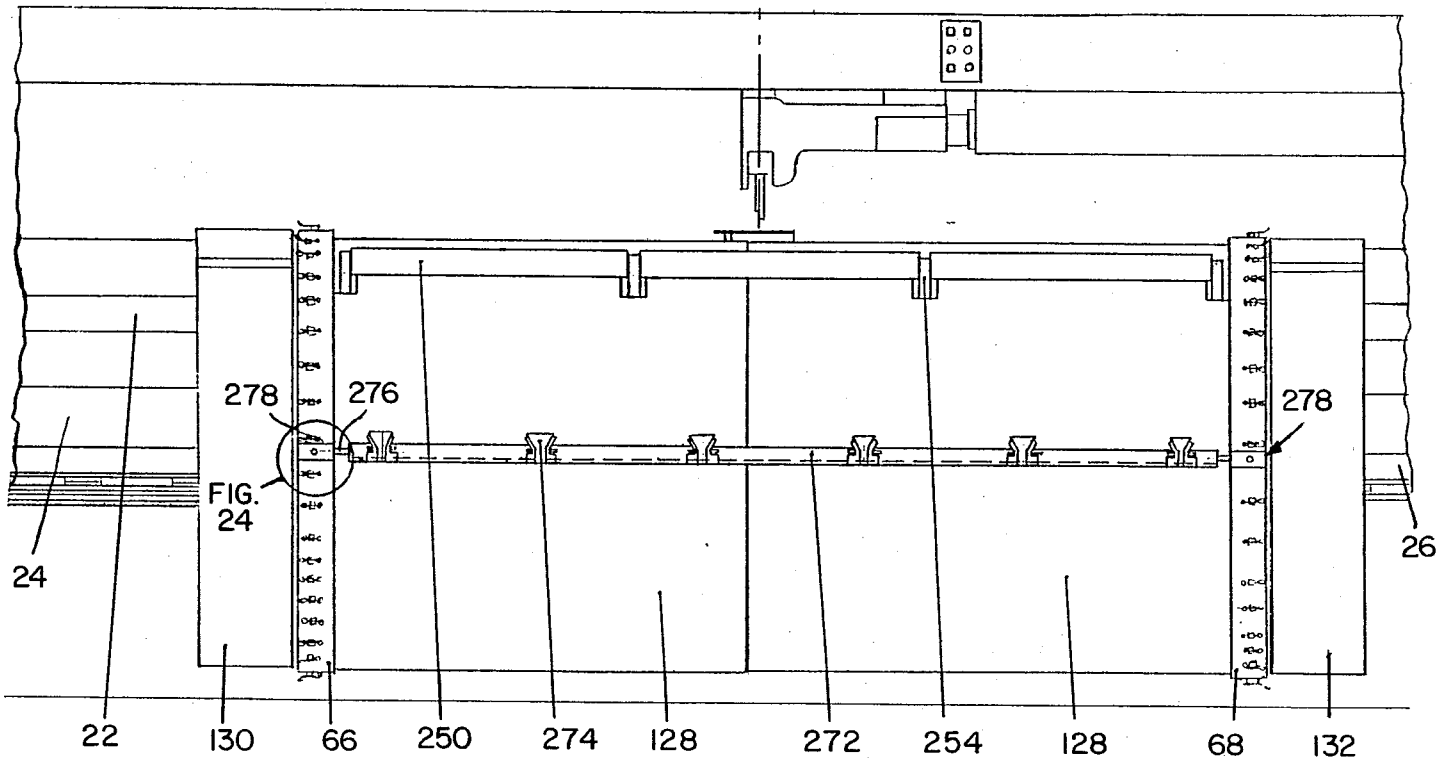
FIG. 23 is a side elevational view of the apparatus of FIG. 1, modified by a clamping assembly which clamps the free end of the fabric stretched on the frame.
Figure 24:
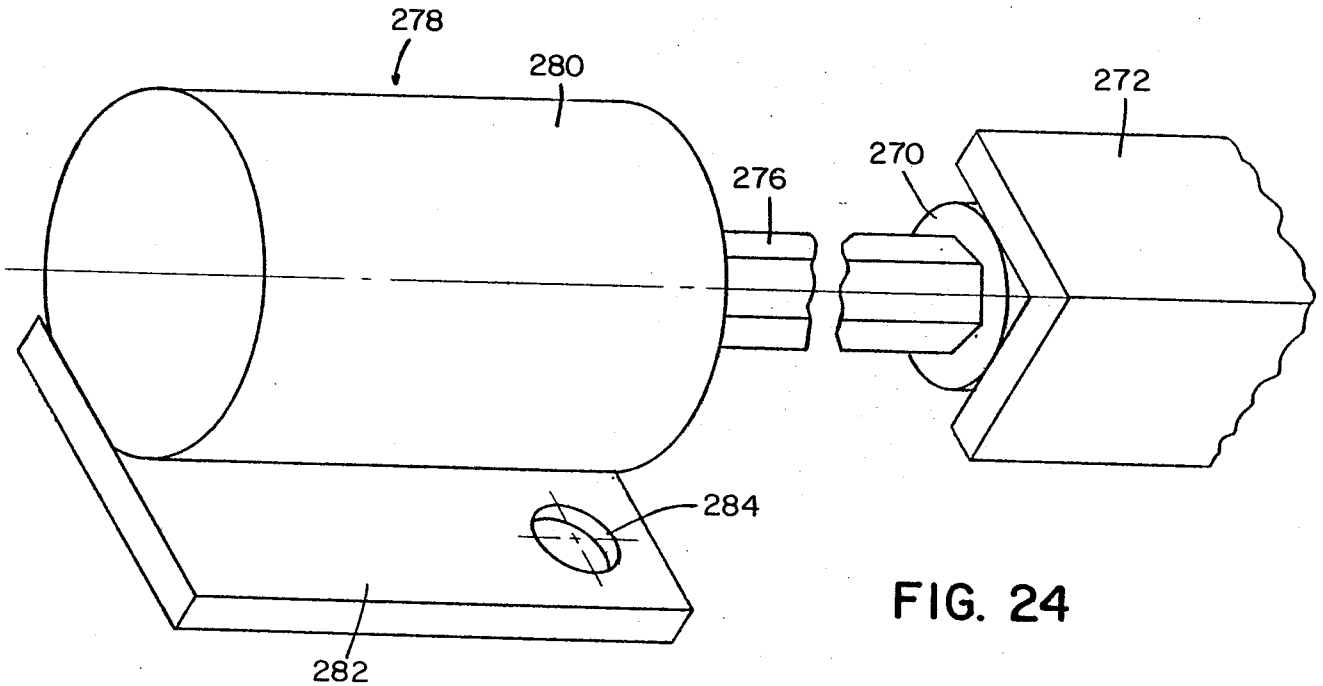
FIG. 24 is an enlarged perspective view of an end of the clamping assembly of FIG. 23, which is used for securing the clamping assembly to the frame.

Referring now to FIGS. 23 and 24, there is shown another aspect of the present invention. Specifically, as shown, a hex bushing 270 extends along the length of frame 14 and has an L-shaped bracket 272 secured thereon. A plurality of clamps 274 are arranged in spaced relation along bracket 272 for clamping the free edge of the fabric supported on frame 14. A hex shaft 276 is slidably received within hex busing 270 and extends substantially along the length thereof. One end of hex shaft 276 is fixedly connected to a removable mounting assembly 278 comprised of a cylindrical member 280 to which the end of hex shaft 276 is fixedly connected and a clamp holder 282 fixed to cylindrical member 280. Clamp holder 282 includes an aperture 284. The opposite end of bracket 270 includes a similar removable mounting assembly 278. To assemble the clamping structure of FIG. 23 to frame 14, clamp holders 282 at opposite ends of the assembly are positioned on inner rings 66 and 68. Then, clamping arms 138 positioned thereabove are pivoted downwardly, as shown by solid lines in FIG. 12, so that clamping member 138*a* of clamping arm 138 fits within apertures 284 at opposite sides of frame 14. As a result, removable mounting assemblies 278 are clamped to opposite sides of frame 14, that is, on top of rings 66 and 68. With this arrangement, the clamping mechanisms of FIGS. 23 and 24 can be moved to any position along the circumference of frame 14.

During operation, with mounting assemblies 278 clamped to opposite sides of frame 14, the fabric is positioned over frame 14 and clamped at the edges thereof to rings 66 and 68 by clamping arms 138. Then frame 14 is expanded to tension the fabric slightly. Because of the arrangement of hex bushing 270 and hex shaft 276, the clamping arrangement of FIGS. 23 and 24 likewise expands. Then, after the fabric has been tensioned, clamps 274 clamp the free end of the fabric. This removes wrinkles or pleats formed in the fabric due to lengthwise stretching thereof in frame 14.

In many instances, it is desirable to perform an "outline quilting operation". Specifically, in such an operation, a design is printed on the quilt and the quilt is stitched along such printed design. A problem that results, however, is that it is difficult to correctly align the printed design and the stitching.

In accordance with an aspect of the present invention for use with frame 14, a spray head 290, for example, of the type sold by Paasche Air Brush Company of Harwood Heights, Ill. is mounted adjacent to sewing head 32 for painting a pattern on the fabric as it passes over bobbin 34.

Figure 25:
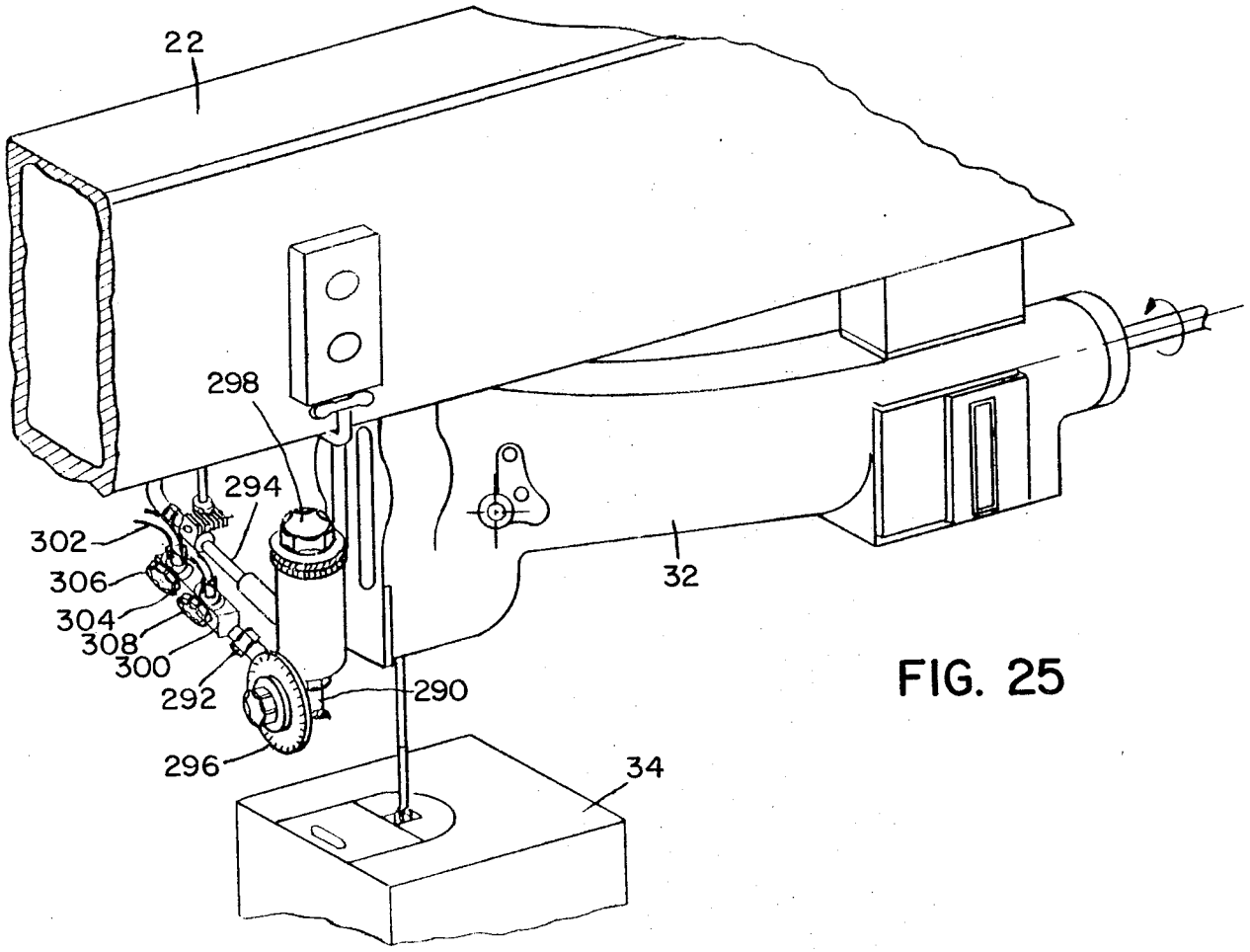
FIG. 25 is a perspective view of a portion of the apparatus of FIG. 1, modified by the addition of a paint head assembly secured adjacent the sewing head.

In the embodiment shown in FIG. 25, paint is supplied through paint supply line 292 to paint head 290 and air is supplied to paint head 290 through air supply line 294. The mixture of air and paint will determine the darkness, brightness, fuzziness and the like of the painted pattern. The amount of air supplied to paint head 290 is controlled by a valve (not shown) through an air control dial 296 and, in like manner, the amount of paint supplied to the nozzle of paint head 290 is controlled by a valve (not shown) through a paint control dial 298. Different angles of spray can be obtained by using different nozzles with paint head 290.

To obtain different colors of paint for the painted pattern, paint supply line 292 is connected through a multi-valve device 300, each valve thereof controlling the amount of paint supplied though a paint supply line 302, 04 and the like by paint control knobs 306, 308 and the like, respectively. Each paint supply line 302 and 304 can supply a single color paint or can be connected at its opposite end to another multi-valve device which selectively supplies one of numerous paints therethrough.

This latter arrangement is preferable so as to minimize the complexity of the apparatus at paint head 290. Thus, since paint head 290 and sewing head 32 are both positioned in fixed relationship on the same machine, movement of frame 14 can be controlled, for example, by a computer, to move through specific movements so that a pattern is painted on the fabric secured thereto. Then, the same series of movements can be performed, whereby the needle of sewing head 32 will sew exactly on the painted pattern. Since the fabric has the same stretch associated therewith during both movements, there will be no misalignment or misregistration of the painted and sewn patterns.

Figure 26:
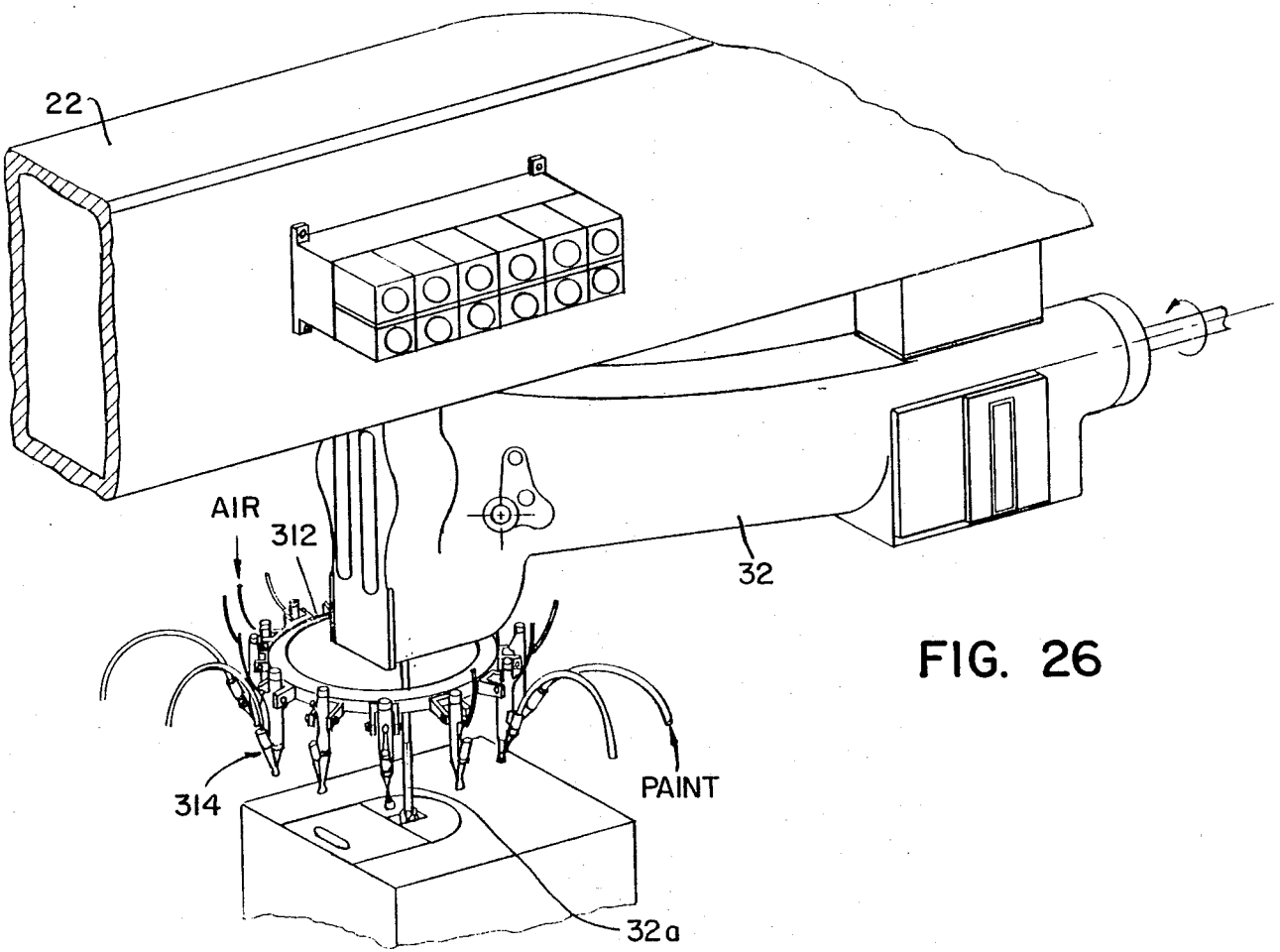
FIG. 26 is a perspective view of a portion of the apparatus of FIG. 1, modified by adding a paint head assembly surrounding the needle of the sewing head in accordance with another embodiment of the present invention.
Figure 27:
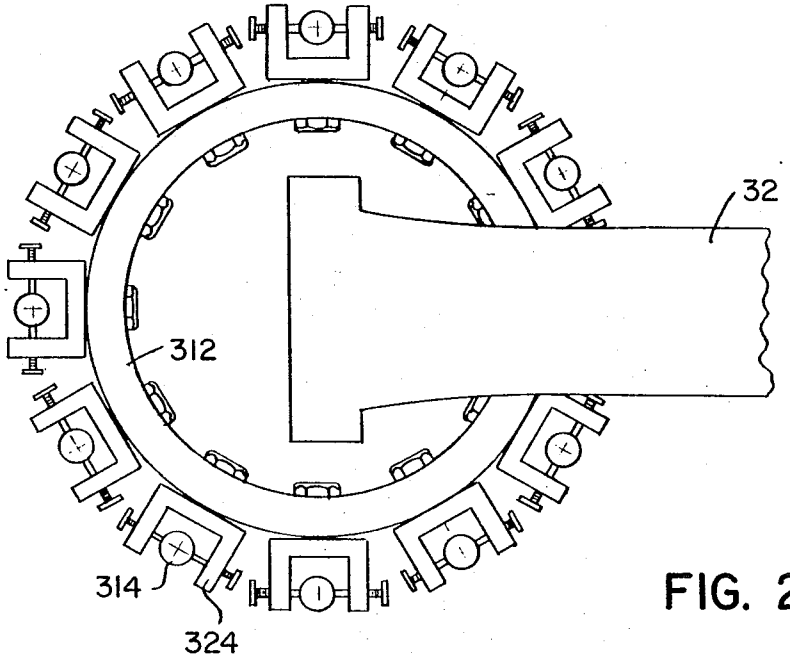
FIG. 27 is a top plan view of a portion of the paint head assembly of FIG. 26.
Figure 28:
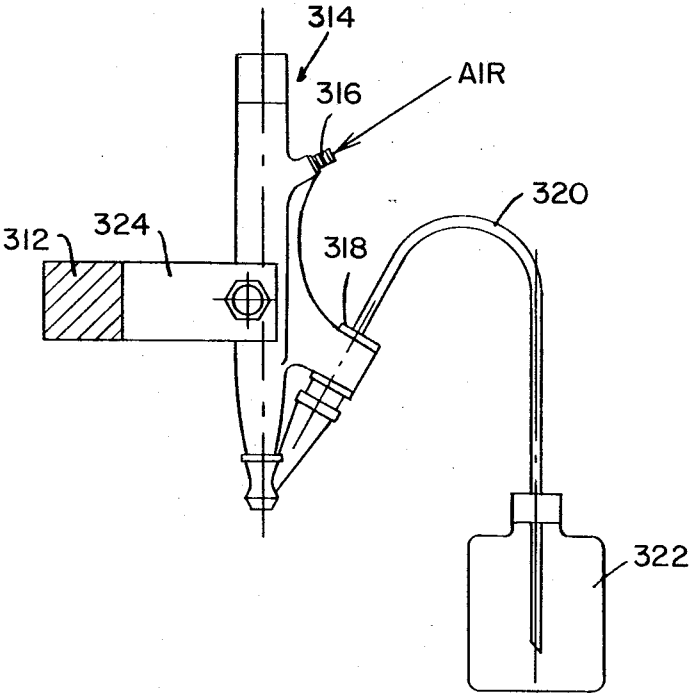
FIG. 28 is an elevational view of one paint head of the paint head assembly of FIG. 26.

Referring now to FIGS. 26–28, there is shown another embodiment of a painting assembly accoring to the present invention. As shown therein, a support ring 312 is mounted to the underside of sewing head 32 in surrounding relation to the needle 32*a* thereof. Secured in spaced relation about the periphery of support ring 312 are a plurality of paint heads 314 which may also be of the type sold by Paasche Air Brush Company. As shown in FIG. 28, each paint head 314 includes an air inlet 316 are a paint inlet 318, the latter being connected through suitable tubing 320 to a supply of paint 322. Thus, each paint head 314 is adapted to supply a specific color of paint.

Further, each paint head 314 is pivotally connected to a U-shaped bracket 324 which is secured to the outer periphery of support ring 312. Thus, the angle of inclination of each paint head 314 can be adjusted.

In the embodiment of FIGS. 26–28, support ring 312 is fixed with respect to sewing head 32. However, support ring 312 could be rotatably mounted with respect to sewing head 32 so that all painting occurs at a fixed reference point. The arrangement of FIGS. 26-28 provides the same advantages of accurate registration between the painted pattern and the stitched pattern.

Figure 29:
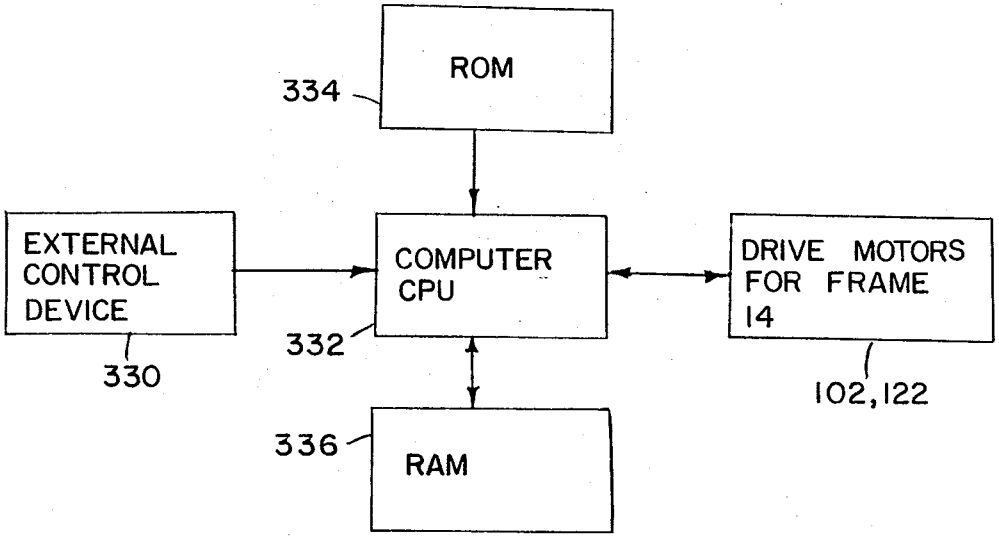
FIG. 29 is a block diagram of apparatus for moving the frame of FIG. 1 along the base thereof by means of an external control device.
Figure 30:
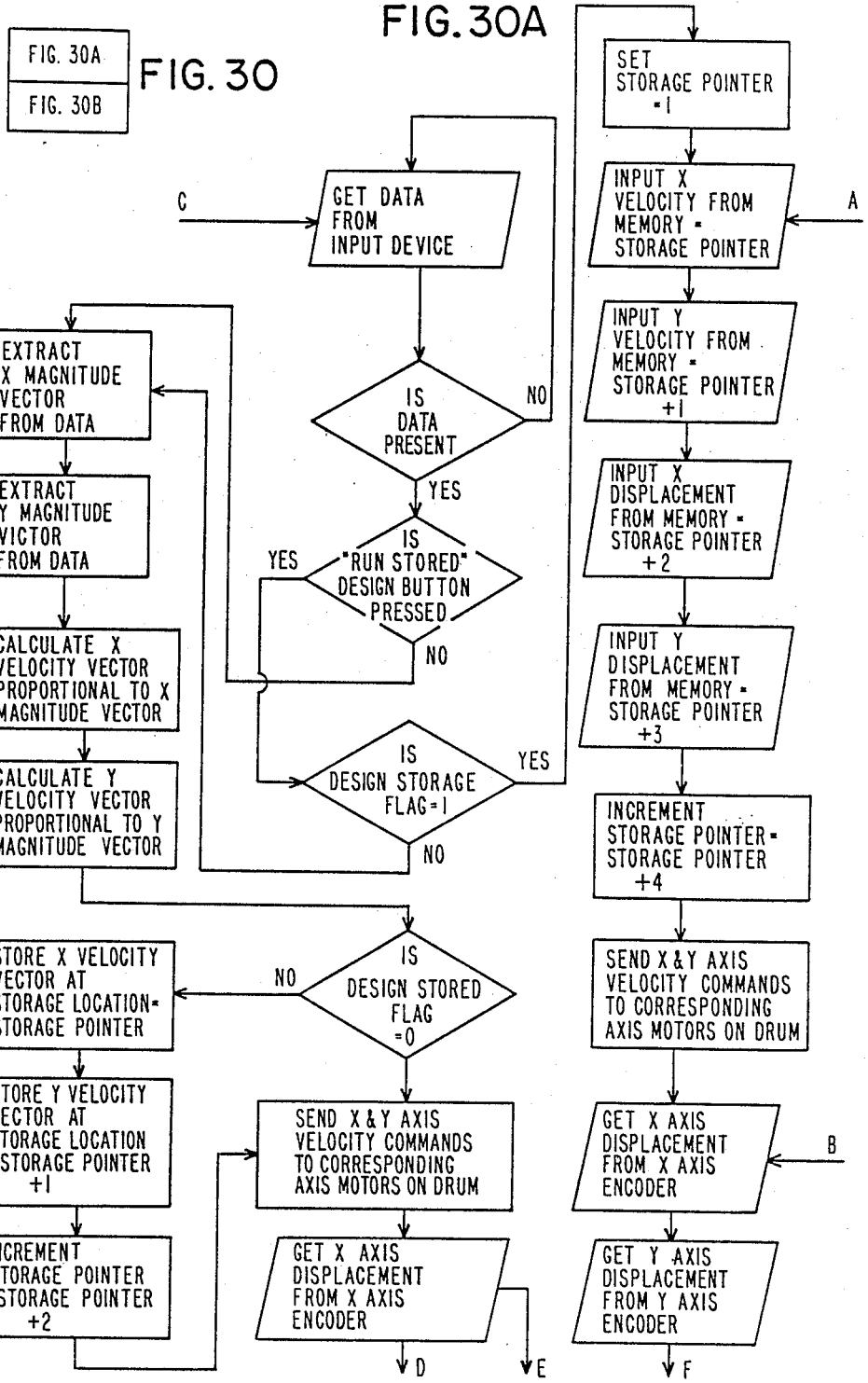
FIG. 30 is a flow chart diagram of software used for operating the external control device of FIG. 29.
Figure 30B:
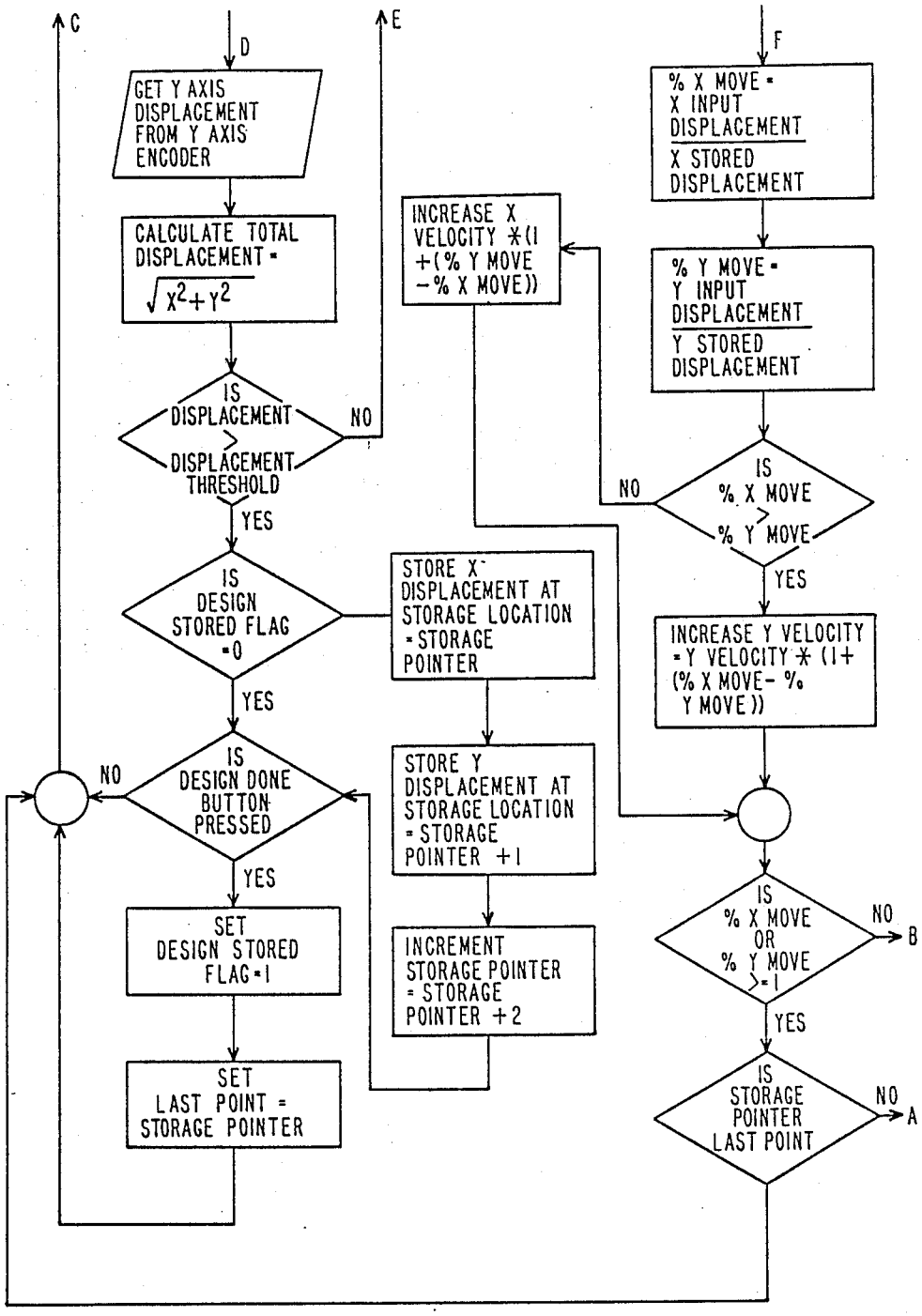

Referring now to FIGS. 29 and 30, in accordance with a last aspect of the present invention, an external control device 330 such as a joy stick, mouse, touch pad or the like is used to trace a pattern on the fabric stretched along frame 14. Specifically, external control device 330 is used to control frame 14 to move longtidinally and in rotation so that a desired pattern is traced thereon.

External control device 330 is connected to a central processing unit (CPU) 332 of a computer, for example, an IBM PC computer, having a read only memory (ROM) 334 which stores a program therein connected to CPU 332, and a random access memory (RAM) 336 also connected to CPU 332. CPU 332 is, in turn, connected to the drive motors for moving frame 14, such as linear drive motor 122 and rotational drive motor 102.

In operation, external control device 330 can be used for numerous operations. For example, external control device 330 can be used to trace a pattern on fabric stretched on frame 14. Then, the pattern that is traced can be stored in RAM 336 or any other suitable storage device associated with the computer so that the same pattern can be retraced numerous times. Thus, external control device 330 can be used for custom jobs. Alternatively, since each fabric has a repeat pattern every approximately 26 inches, when stitching over a pattern, due to stretch in the fabric, there may be misalignment between the pattern and the stitching. Therefore, external control device 330 can be used as a correction device for correctly aligning the printed pattern and stitched pattern, that is, the mouse, for example can be manually controlled to correctly trace over the pattern to correct misalignment. In addition to CPU 332 controlling drive motors 102 and 122, it can also control the drive motor which controls the speed of movement of the needle on sewing head 32 to control the sewing speed and thereby the spacing of the thread.

A flow chart diagram is shown in FIG. 30 which can be stored in ROM 334 for controlling CPU 332 in response to external control device 330. The software for such program is relatively simple and can be easily constructed by one of ordinary skill in the art from the flow chart diagram of FIG. 30.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined by the appended claims.

What is claimed is:

1. A quilting machine comprising:

(a) base;

(b) a substantially cylindrically shaped frame slidably and rotatably mounted on said base, said frame including:

(i) a first end assembly;

(ii) a second end assembly;

(iii) each end assembly having a support member slidably mounted on said base and a ring rotatably mounted on the respective support member, each ring having a plurality of gear teeth spaced therearound;
(iv) said first and second end assemblies spaced from each other on said base;
(v) a plurality of first telescoping rods secured to said first end assembly and extending toward said second end assembly;
(vi) a plurality of second telescoping rods secured to said second end assembly and extending toward said first end assembly;
(vii) each first telescoping rod telescopically receiving a respective second telescoping rod;
(viii) at least one first telescoping rod screw-threadedly receiving at least one respective second telescoping rod;
(ix) at least one first and second telescoping rod rotatably fixed and axially movable with respect to each other; and
(x) a gear on each of said first and second rotatably fixed and axially movable telescoping rods in mating engagement with said gear teeth of said rings;
(c) rotation means for rotating said rings with respect to said support members and including first rod rotation means for rotating said first and second rotatably fixed and axially movable telescoping rods;
(d) elongation means for changing the length of said frame, including second rod rotation means for rotating at least one screw-threaded rod; and
(e) frame moving means for axially moving the frame along said base, said frame moving means including a lead screw having a helical thread secured to said base, drive means mounted on said frame in rotatable engagement with said lead screw for movement therealong, and control means for controlling rotation of one of said drive means and said lead screw to move said frame along said base.

2. A quilting machine according to claim 1; wherein said base includes first and second end supports and at least one bridge extending between said end supports; and said frame is slidably mounted on said at least one bridge.

3. A quilting machine according to claim 2; wherein said drive means is mounted on said frame, and said control means includes motor means mounted on said frame for rotating said drive means to move said frame along said at least one bridge.

4. A quilting machine according to claim 3; wherein said drive means includes ball bearing drive means rotatably engaged in said helical thread of said lead screw and rotatably mounted on said frame and pulley means mounted with said ball bearing drive means for rotation therewith; and said control means further includes an output drive shaft of said drive motor means, second pulley means rotatably mounted on said output drive shaft and belt means for connecting said first and second pulley means to rotate said ball bearing drive means through said output drive shaft and said first and second pulley means, whereby rotation of said ball bearing drive means causes said frame to move longitudinally with respect to said base.

5. A quilting machine according to claim 2; wherein said drive means is mounted on said frame, and said control means includes motor means mounted on said base for rotating said lead screw to move said frame along said at least one bridge.

6. A quilting machine according to claim 3; wherein said drive means includes ball bearing drive means rotatably engaged in said helical thread of said lead screw and rotatably mounted on said frame, and said control means further includes an output drive shaft of said drive motor means directly connected to said lead screw to rotate the latter.

7. A quilting machine comprising:
(a) a base;
(b) a substantially cylindrically shaped frame slidably and rotatably mounted on said base, said frame including:
(i) a first end assembly;
(ii) a second end assembly;
(iii) each end assembly having a support member slidably mounted on said base and a ring rotatably mounted on the respective support member, each ring having a plurality of gear teeth spaced therearound;
(iv) said first and second end assemblies spaced from each other on said base;
(v) a plurality of first telescoping rods secured to said first end assembly and extending toward said second end assembly;
(vi) a plurality of second telescoping rods secured to said second end assembly and extending toward said first end assembly;
(vii) each first telescoping rod telescopically receiving a respective second telescoping rod;
(viii) at least one first telescoping rod screw-threadedly receiving at least one respective second telescoping rod;
(ix) at least one first and second telescoping rod rotatably fixed and axially movable with respect to each other; and
(x) a gear on each of said first and second rotatably fixed and axially movable telescoping rods in mating engagement with said gear teeth of said rings;
(c) rotation means for rotating said rings with respect to said support members and including first rod rotation means for rotating said first and second rotatably fixed and axially movable telescoping rods;
(d) elongation means for changing the length of said frame, including second rod rotation means for rotating at least one screw-threaded rod; and
(e) frame moving means for axially moving the frame along said base, said frame moving means including first roller means secured to one end of said base, second roller means secured to a second, opposite end of said base, belt means wrapped about said first and second roller means and secured to said frame for moving said frame longitudinally with respect to said base, and drive means for rotatably driving one of said rollers.

8. A quilting machine according to claim 7; further including first and second transducer means secured to said frame and positioned out of phase with respect to each other for detecting the speed and direction of movement of said frame with respect to said base.

9. A quilting machine comprising:
(a) a base;
(b) a substantially cylindrically shaped frame slidably and rotatably mounted on said base, said frame including:
(i) a first end assembly;
(ii) a second end assembly;
(iii) each end assembly having a support member slidably mounted on said base and a ring rotatably mounted on the respective support member, each ring having a plurality of gear teeth spaced thereround;

(iv) said first and second end assemblies spaced from each other on said base;

(v) a plurality of first telescoping rods secured to said first end assembly and extending toward said second end assembly;

(vi) a plurality of second telescoping rods secured to said second end assembly and extending toward said first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of said first and second rotatably fixed and axially movable telescoping rods in mating engagement with said gear teeth of said rings;

(c) rotation means for rotating said rings with respect to said support members and including first rod rotation means for rotating said first and second rotatably fixed and axially movable telescoping rods;

(d) elongation means for changing the length of said frame, including second rod rotation means for rotating at least one screw-threaded rod; and (e) frame moving means for axially moving the frame along said base, said frame moving means including chain means secured to opposite ends of said base for guiding said frame therealong, gear means mounted on said frame and in engagement with said chain means for moving along said chain means during rotation of said gear means, and drive means connected to said gear means and to said frame for driving said gear means to cause said frame to move axially along said base.

10. A quilting machine according to claim 9; wherein said gear means includes gear box means secured to said frame and having an input and an output gear, said chain means being wrapped about said output gear, and said drive means includes motor mean for driving said input gear.

11. A quilting machine according to claim 10; further including idler gears secured to said frame for guiding said chain means about said output gear in a tensioned manner.

12. A quilting machine comprising:

(a) a base;

(b) a substantially cylindrically shaped frame slidably and rotatably mounted on said base, said frame including:

(i) a first end assembly;

(ii) a second end assembly;

(iii) each end assembly having a support member slidably mounted on said base and a ring rotatably mounted on the respective support member, each ring having a plurality of gear teeth spaced thereround;

(iv) said first and second end assemblies spaced from each other on said base;

(v) a plurality of first telescoping rods secured to said first end assembly and extending toward said second end assembly;

(vi) a plurality of second telescoping rods secured to said second end assembly and extending toward said first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of said first and second rotatably fixed and axially movable telescoping rods in mating engagement with said gear teeth of said rings;

(c) rotation means for rotating said rings with respect to said support members and including first rod rotation means for rotating said first and second rotatably fixed and axially movable telescoping rods;

(d) elongation means for changing the length of said frame, including second rod rotation means for rotating at least one screw-threaded rod; and (e) frame moving means for axially moving the frame along said base, said frame moving means including chain means for guiding said frame axially along said base, said chain means having a first end connected to said first end assembly and a second end connected to said second end assembly, gear means secured to said base in engagement with said chain means for moving along said chain means during rotation of said gear means, and drive means secured to said base for rotatably driving said gear means.

13. A quilting machine according to claim 12; wherein said gear means includes a gear box secured to said base and having an output gear about which said chain is wrapped and an input gear driven by said driving means.

14. A quilting machine according to claim 12; further including a plurality of idler gears for guiding said chain means about said output gear.

15. A quilting machine according to claim 12; further including spring biased roller means connected to said base for applying a tension force on said second end of said chain means, and said second end of said chain means also being removably connected to said second end assembly.

16. A quilting machine comprising:

(a) a base;

(b) a substantially cylindrically shaped frame slidably and rotatably mounted on said base, said frame including:

(i) a first end assembly;

(ii) a second end assembly;

(iii) each end assembly having a support member slidably mounted on said base and a ring rotatably mounted on the respective support member, each ring having a plurality of gear teeth spaced thereround;

(iv) said first and second end assemblies spaced from each other on said base;

(v) a plurality of first telescoping rods secured to said first end assembly and extending toward said second end assembly;

(vi) a plurality of second telescoping rods secured to said second end assembly and extending toward said first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of said first and second rotatably fixed and axially movable telescoping rods in mating engagement with said gear teeth of said rings;

(c) rotation means for rotating said rings with respect to said support members and including first rod rotation means for rotating said first and second rotatably fixed and axially movable telescoping rods;

(d) elongation means for changing the length of said frame, including second rod rotation means for rotating at least one screw-threaded rod;

(e) sewing means positioned on said base for stitching a fabric stretched on said frame; and (f) friction roller means for guiding said fabric with respect to said sewing means, said friction roller means including a plurality of friction rollers rotatably mounted to said frame and rotatable by said rotation means, each friction roller having a height substantially even with said rings.

17. A quilting machine according to claim 16; wherein there are two rows of linearly arranged friction rollers, the friction rollers in each roll being mounted on a roller support shaft which is rotated by said rotation means to cause rotation of said friction rollers in correspondence with rotation of said rings.

18. A quilting machine comprising:

(a) a base;

(b) a substantially cylindrically shaped frame slidably and rotatably mounted on said base, said frame including:

(i) a first end assembly;

(ii) a second end assembly;

(iii) each end assembly having a support member slidably mounted on said base and a ring rotatably mounted on the respective support member, each ring having a plurality of gear teeth spaced therearound;

(iv) said first and second end assemblies spaced from each other on said base;

(v) a plurality of first telescoping rods secured to said first end assembly and extending toward said second end assembly;

(vi) a plurality of second telescoping rods secured to said second end assembly and extending toward said first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of said first and second rotatably fixed and axially movable telescoping rods in mating engagement with said gear teeth of said rings;

(c) rotation means for rotating said rings with respect to said support members and including first rod rotation means for rotating said first and second rotatably fixed and axially movable telescoping rods;

(d) elongation means for changing the length of said frame, including second rod rotation means for rotating at least one screw-threaded rod; and (e) clamp means extending axially of said frame for clamping a free end of a fabric tensioned on said frame.

19. A quilting machine according to claim 18; wherein said clamping means includes first and second telescoping members, said first telescoping member having a free end secured to one of said rings and said second telescoping member having a free end secured to the other of said rings, and a plurality of clamp members positioned on at least one of said telescoping members for clamping the free end of said fabric.

20. A quilting machine according to claim 19; further including clamping members secured around the outer periphery of each ring for clamping said fabric at opposite ends thereof, and said clamping means further includes mounting assemblies at the free ends of said first and second telescoping members, each mounting assembly including clamp holder means for engagement by a respective clamping member on a respective ring to hold said clamping means on said frame.

21. A quilting machine comprising:

(a) a base;

(b) a substantially cylindrically shaped frame slidably and rotatably mounted on said base, said frame including:

(i) a first end assembly;

(ii) a second end assembly;

(iii) each end assembly having a support member slidably mounted on said base and a ring rotatably mounted on the respective support member, each ring having a plurality of gear teeth spaced therearound;

(iv) said first and second end assemblies spaced from each other on said base;

(v) a plurality of first telescoping rods secured to said first end assembly and extending toward said second end assembly;

(vi) a plurality of second telescoping rods secured to said second end assembly and extending toward said first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of said first and second rotatably fixed and axially movable telescoping rods in mating engagement with said gear teeth of said rings;

(c) rotation means for rotating said rings with respect to said support members and including first rod rotation means for rotating said first and second rotatably fixed and axially movable telescoping rods;

(d) elongation means for changing the length of said frame, including second rod rotation means for rotating at least one screw-threaded rod;

(e) sewing head means having a needle positioned above a fabric stretched on said frame for sewing a pattern on said fabric; and (f) paint head means positioned above said fabric and adjacent said sewing head means for painting a pattern on said fabric.

22. A quilting machine according to claim 21; wherein said paint head means includes a single paint head having a paint inlet and an air inlet, and a plurality of valve means for selectively supplying paint from different paint supply sources to said single paint head.

23. A quilting machine according to claim 21; wherein said paint head means includes a plurality of paint heads arranged circumferentially about said needle.

24. A quilting machine comprising:

(a) a base;

(b) a substantially cylindrically shaped frame slidably and rotatably mounted on said base, said frame including:

(i) a first end assembly;

(ii) a second end assembly;

(iii) each end assembly having a support member slidably mounted on said base and a ring rotatably mounted on the respective support member, each ring having a plurality of gear teeth spaced thereround;

(iv) said first and second end assemblies spaced from each other on said base;

(v) a plurality of first telescoping rods secured to said first end assembly and extending toward said second end assembly;

(vi) a plurality of second telescoping rods secured to said second end assembly and extending toward said first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of said first and second rotatably fixed and axially movable telescoping rods in mating engagement with said gear teeth of said rings;

(c) rotation means for rotating said rings with respect to said support members and including first rod rotation means for rotating said first and second rotatably fixed and axially movable telescoping rods;

(d) elongation means for changing the length of said frame, including second rod rotation means for rotating at least one screw-threaded rod; and (e) external control means for controlling movement of said frame in response to a manual input.

25. A quilting machine according to claim 24; wherein said external control means is one of a mouse, joy stick and key pad.

26. A quilting machine comprising:

(a) a base;

(b) a substantially cylindrically shaped frame slidably and rotatably mounted on said base, said frame including:

(i) a first end assembly;

(ii) a second end assembly;

(iii) each end assembly having a support member slidably mounted on said base and a ring rotatably mounted on the respective support member, each ring having a plurality of gear teeth spaced thereround;

(iv) said first and second end assemblies spaced from each other on said base;

(v) a plurality of first telescoping rods secured to said first end assembly and extending toward said second end assembly;

(vi) a plurality of second telescoping rods secured to said second end assembly and extending toward said first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of said first and second rotatably fixed and axially movable telescoping rods in mating engagement with said gear teeth of said rings;

(c) rotation means for rotating said rings with respect to said support members and including first rod rotation means for rotating said first and second rotatably fixed and axially movable telescoping rods;

(d) elongation means for changing the length of said frame, including second rod rotation means for rotating at least one screw-threaded rod;

(e) frame moving means for axially moving the frame along said base;

(f) sewing means having a needle positioned above a fabric stretched on said frame for sewing a pattern on said fabric;

(g) paint head means positioned above said fabric and adjacent said sewing means for painting a pattern on said fabric.

(h) friction roller means for guiding said fabric with respect to said sewing means, said friction roller means including a plurality of friction rollers rotatably mounted to said frame and rotatable by said rotation means, each friction roller having a height substantially even with said rings;

(i) clamp means extending axially of said frame for clamping a free end of a fabric tensioned on said frame; and (j) external control means for controlling movement of said frame in response to a manual input.

* * * * *